US007766445B2

(12) United States Patent
Akiyama et al.

(10) Patent No.: US 7,766,445 B2
(45) Date of Patent: Aug. 3, 2010

(54) INKJET RECORDING APPARATUS

(75) Inventors: Shigeki Akiyama, Ichinomiya (JP); Mitsuhiro Nozaki, Nagoya (JP); Masatoshi Kokubo, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 464 days.

(21) Appl. No.: 11/319,052

(22) Filed: Dec. 28, 2005

(65) Prior Publication Data

US 2006/0139385 A1 Jun. 29, 2006

(30) Foreign Application Priority Data

Dec. 28, 2004 (JP) ..... 2004-381923

(51) Int. Cl.
*B41J 29/393* (2006.01)

(52) U.S. Cl. ..... 347/19; 347/5; 347/14

(58) Field of Classification Search ..... 347/5, 347/9, 35, 14, 15, 19
See application file for complete search history.

(56) References Cited

U.S. PATENT DOCUMENTS 5,821,954 A * 10/1998 Imai et al. ..... 347/35

FOREIGN PATENT DOCUMENTS

| | | |
|---|---|---|
| JP | 6 92521 | 4/1994 |
| JP | 6 171178 | 6/1994 |
| JP | 8 119533 | 5/1996 |
| JP | 10 157137 | 6/1998 |
| JP | 11 194570 | 7/1999 |

* cited by examiner

*Primary Examiner*—Lam S Nguyen
(74) *Attorney, Agent, or Firm*—Baker Botts L.L.P.

(57) ABSTRACT

An inkjet recording apparatus of a serial recording type which comprises a recording head, a carriage and a conveying device. The recording head is capable of selectively ejecting ink toward a recording medium. The carriage with the recording head mounted thereon reciprocatingly moves in specified directions. The conveying device intermittently conveys the recording medium in a direction perpendicular to the specified directions when the recording head does not eject ink. An image is recorded on the recording medium by repeatedly performing, in turn, movement of the carriage and ejection of ink by the recording head, and intermittent conveyance of the recording medium by the conveying device. The inkjet recording apparatus also includes a vibration applying device that vibrates at least one of the recording medium and the recording head when the recording head ejects ink toward the recording medium while the carriage is being moved.

22 Claims, 23 Drawing Sheets

FRONT
2
3
10
10a
10b
10c
10d
10e
10f
11
12
13
14
15
15a
15b
15c
15d
16
16a
16b
16c
16d
17
20
21a
21b
21c
21d
22a, 22b
22c, 22d
23
24
25
26
30
31
32
33
39
40
41
42
43
44
45
46
47
48
50
51
52
68

FIG.7

| | |
|---|---|
| rndval | : GENERATED RANDOM SIGNAL |
| oprval | : DIGITIZED RANDOM SIGNAL |
| ctrlval | : OBTAINED MOVING AMOUNT OF PAPER |
| Σ oprval | : INTEGRATED VALUE OF DIGITIZED RANDOM SIGNAL |
| Σ ctrlval | : INTEGRATED VALUE OF OBTAINED MOVING AMOUNT |
| Threshold_out | : THRESHOLD FOR DIGITIZING RANDOM SIGNAL |
| jdg_val | : PARAMETER FOR DETERMINING CHANGE OF THRESHOLD |
| th_delta | : PARAMETER FOR ADDING AND SUBTRACTING THRESHOLD |

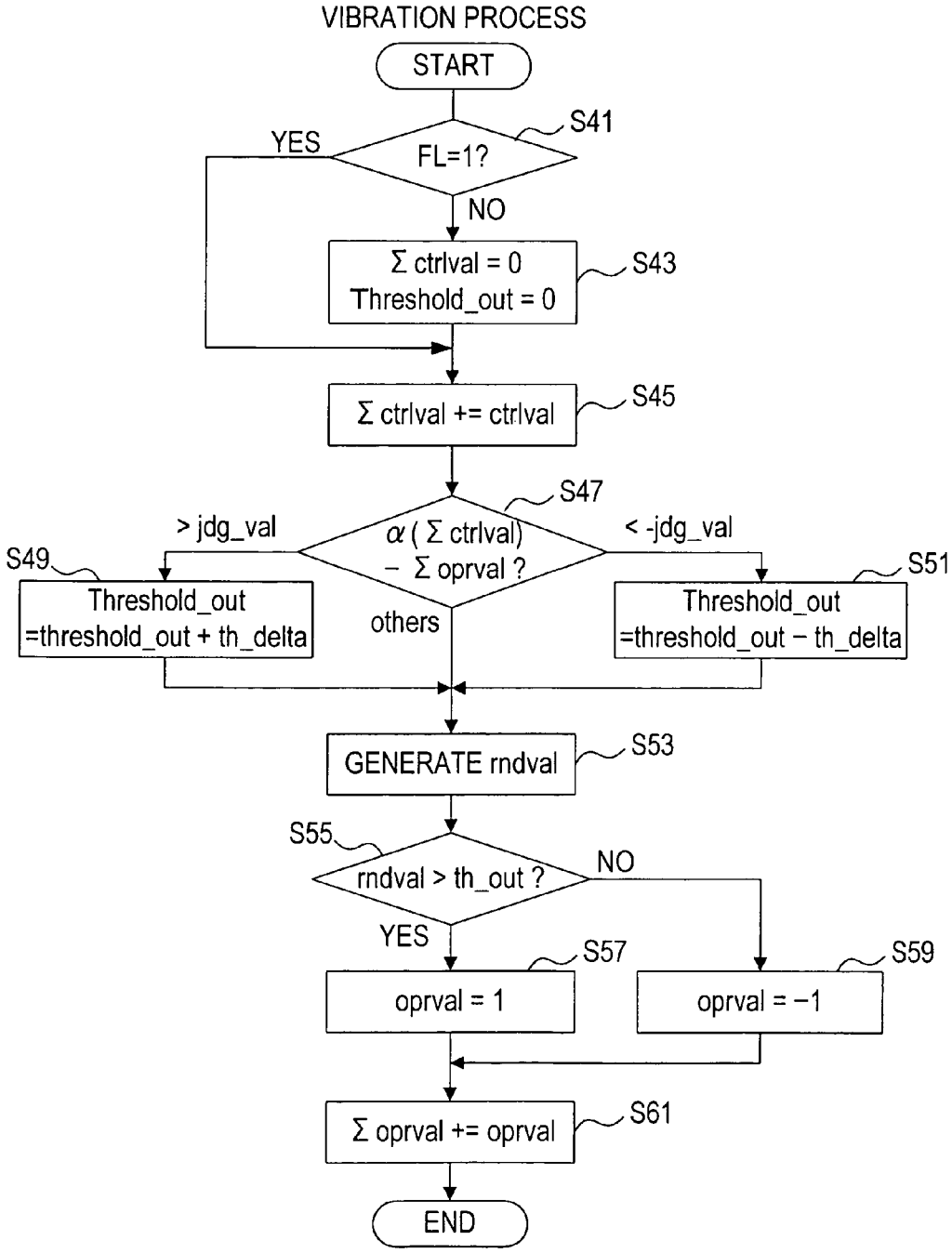

TRANSVERSE LINE BECOMES INVISIBLE DUE TO SCATTERED LANDING POINTS OF INK DROPLETS BY VIBRATION BY CONVEYING ROLLER.

PRINTING BY FIRST CARRIAGE OPERATION

PRINTING BY SECOND CARRIAGE OPERATION

PRINTING BY THIRD CARRIAGE OPERATION

PRINTING BY FOURTH CARRIAGE OPERATION

POSITIONAL CHANGE DURING RANDOM VIBRATION

HISTOGRAM OF MULTI-VALUED RANDOM SIGNAL WITH AVERAGE VALUE OF -0.5

INKJET RECORDING APPARATUS

CROSS-REFERENCE TO RELATED APPLICATIONS

This application claims the benefit of Japanese Patent Application No. 2004-381923 filed Dec. 28, 2004 in the Japanese Patent Office, the disclosure of which is incorporated herein by reference.

BACKGROUND

The present invention relates to an inkjet recording apparatus of a serial recording type provided with a recording head that ejects ink toward a recording medium such as recording paper and a conveying device such as a conveyer roller that coveys the recording medium.

In an inkjet recording apparatus of a serial recording type, as is well known, when ink is not ejected from a recording head toward a recording medium, the recording medium is displaced, while when the recording medium is not displaced, the recording head is made to reciprocably scan and eject ink toward the recording medium. Thus, images or characters are recorded on the recording medium. In other words, intermittent conveyance of the recording medium and recording of an image or the like are repeated in turn so that a piece of image or the like is formed in the inkjet recording apparatus.

In such an inkjet recording apparatus, in which a piece of image is formed while the recording medium is intermittently conveyed, the following problem is likely to be caused. Specifically, if the conveying amount differs at each conveyance, and points of ink droplets deposited (landing) on the recording medium are different from intended controlled points, a white line or a thick line (such defective recording is hereinafter referred to as "banding") extending in a direction parallel with a scanning direction (a main scanning direction) of the recording head is likely to appear, as shown in FIG. 20.

Major causes of banding are, for example, a low stopping accuracy of the conveying roller and eccentricity of the conveying roller. Improvement in the stopping accuracy of the conveying roller or reduction of the eccentricity of the conveying roller requires use of an expensive motor or a component with a high accuracy, and thus is likely to cause an increase in manufacturing cost of the inkjet recording apparatus.

There is a known technique in which banding is prevented from appearing by first determining the number of scannings based on an arrangement pitch kq of recording elements in a recording head and an pixel pitch q of an image and subsequently ejecting ink a plurality of times toward a point in the same position to create an image.

Since a variety of components in actual products have dimensional variations within respective specified ranges, individual products are usually slightly different from one another in stopping accuracy of a conveying roller and in eccentricity of the conveying roller.

Accordingly, if the above technique is applied to actual commercial products, an actual inkjet recording apparatus will be different from an ideal inkjet recording apparatus or an experimental inkjet recording apparatus, which is used for determining a scanning number, due to variations in individual products. It is, therefore, difficult to securely prevent appearance of banding.

It is required to increase dimensional accuracy and the like of each of the components in order to reduce variations in individual products. Then, application of the above technique will lead to an increase in manufacturing cost of the inkjet recording apparatus.

SUMMARY

One aspect of the present invention may provide an inkjet recording apparatus that securely prevents appearance of banding even in the case of variations in individual products.

In the one aspect of the present invention, there is provided an inkjet recording apparatus of a serial recording type which comprises a recording head, a carriage and a conveying device. The recording head is capable of selectively ejecting ink toward a recording medium. The carriage with the recording head mounted thereon reciprocatingly moves in specified directions. The conveying device intermittently conveys the recording medium in a direction perpendicular to the specified directions when the recording head does not eject ink.

An image is recorded on the recording medium by repeatedly performing, in turn, movement of the carriage and ejection of ink by the recording head, and intermittent conveyance of the recording medium by the conveying device.

The inkjet recording apparatus also includes a vibration applying device that vibrates at least one of the recording medium and the recording head, thereby causing a relative vibration displacement between the recording medium and the recording head, when the recording head ejects ink toward the recording medium while the carriage is being moved.

According to the above described configuration, it is possible to minutely scatter deposit points (landing points) of ink droplets when ink is ejected from the recording head toward the recording medium in order to form an image or a character. Accordingly, even if the conveying amount differs at each conveyance, banding may be invisible.

Thus, appearance of banding can be prevented without employing an expensive motor or a component with a high accuracy, or increasing dimensional accuracies of components from the current level, and it is, therefore, possible to securely prevent appearance of banding even when individual inkjet recording apparatuses have variations.

BRIEF DESCRIPTION OF THE DRAWINGS

Preferred embodiments of the present invention will be described hereinafter with reference to the drawings, in which:

FIG. 7 is a flowchart showing a vibration process flow of the printer according to the first embodiment of the present invention;

DETAILED DESCRIPTION OF THE PREFERRED EMBODIMENTS

First Embodiment

The present embodiment is an example of applying the present invention to a multifunction apparatus 1 including a printer function, a copier function, a scanner function, a facsimile function and a telephone function.

Figure 1:
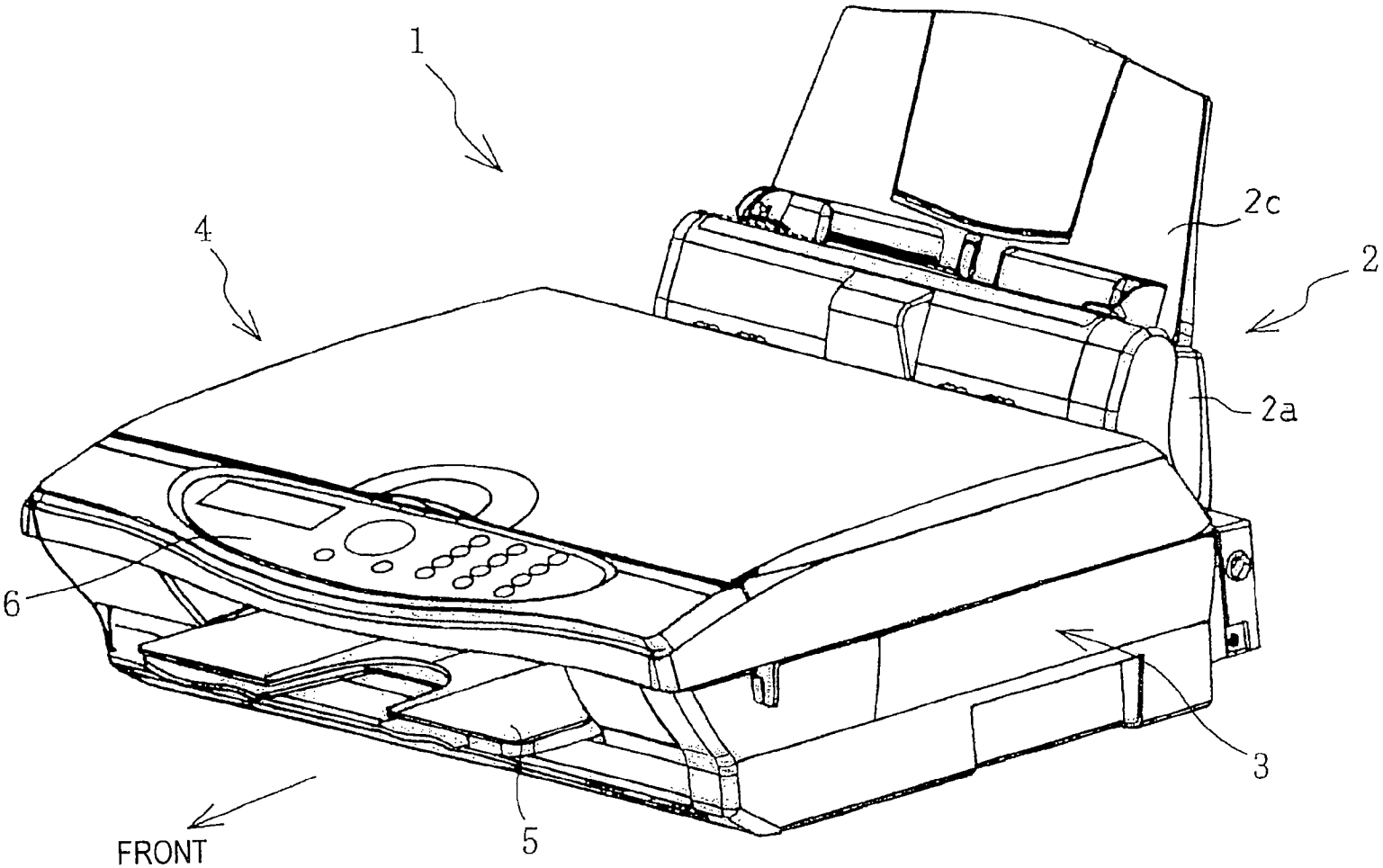
FIG. 1 is a perspective view showing a multifunction apparatus according to the embodiments of the present invention.

As shown in FIG. 1, the multifunction apparatus 1 comprises a paper feeder 2 disposed at a rear end of the multifunction apparatus 1, a serial recording type inkjet printer 3 (hereinafter referred to as the "printer") disposed below and in front of the paper feeder 2, a reading device 4 for performing the copier function and the facsimile function disposed on the printer 3. A paper discharge tray 5 is disposed on a front side of the printer 3, and an operation panel 6 is disposed at a front end of an upper surface of the reading device 4.

The paper feeder 2 includes a slanting wall portion 2*a* for holding recording paper in a slanting state and a paper guide 2*c* attachably/detachably fitted to the slanting wall portion 2*a*. A plurality of sheets of recording paper can be stacked on the paper guide 2*c*. The slanting wall portion 2*a* is equipped with a paper feed roller 2*d* (see FIG. 3). When the paper feed roller 2*d* is rotated, the recording paper stacked on the paper guide 2*c* is conveyed to the printer 3 sheet by sheet.

An explanation of the printer 3 will now be made with reference to FIGS. 2 and 3.

Figure 2:
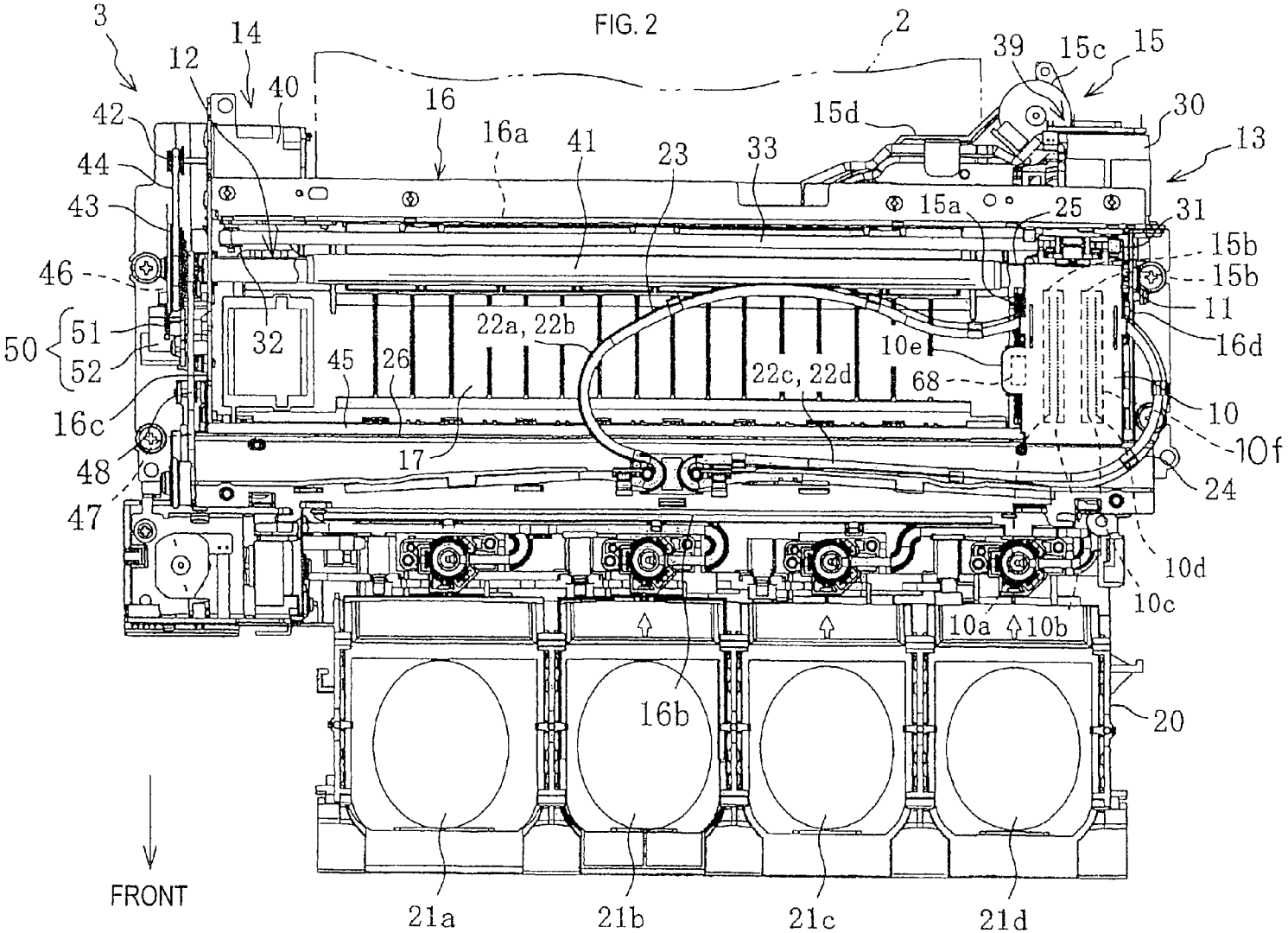
FIG. 2 is a plan view showing a printer portion of the multifunction apparatus according to the embodiments of the present invention.
Figure 3:
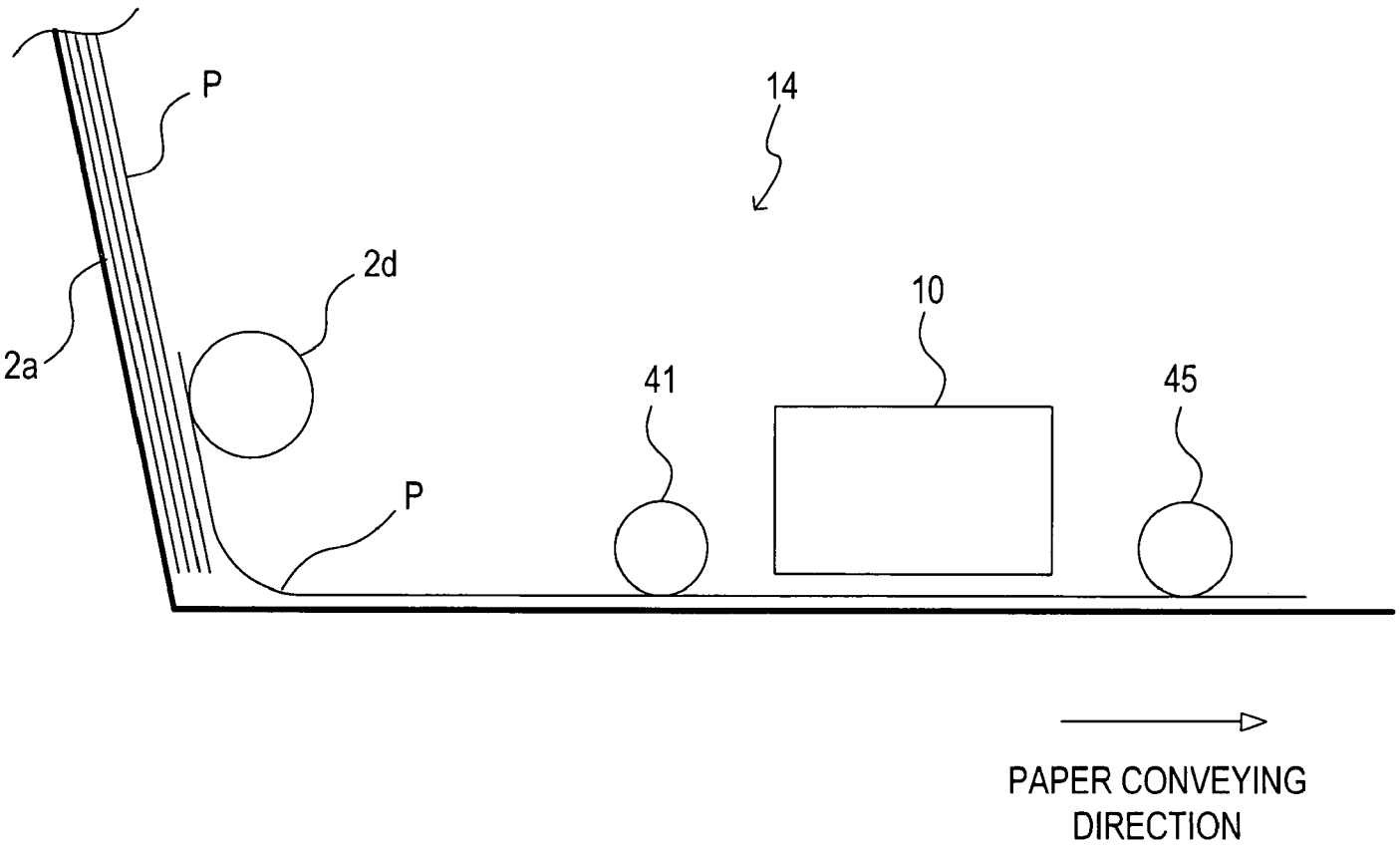
FIG. 3 is an explanatory view showing a recording paper conveying system in the multifunction apparatus according to the embodiments (except a fifth embodiment) of the present invention.

As shown in FIG. 2, the printer 3 includes a recording head 10, a carriage 11, a guide mechanism 12, a carriage moving mechanism 13, a paper conveying mechanism 14*a*, and a maintenance mechanism 15 for the recording head 10. The recording head 10 is mounted on the carriage 11. The guide mechanism 12 guidingly holds the carriage 11 so as to be movable in right and left directions as a main scanning direction. The carriage moving mechanism 13 moves the carriage 11 in right and left directions. The paper conveying mechanism 14 conveys the recording paper fed by the paper feeder 2 in a direction perpendicular to the main scanning direction.

The printer 3 also includes a frame 16 having a rectangular configuration with a longer dimension in right and left directions and a shorter dimension in up and down directions in FIG. 2. The guide mechanism 12, the carriage moving mechanism 13, the paper conveying mechanism 14 and the maintenance mechanism 15 are mounted on the frame 16. In addition, the recording head 10 and the carriage 11 are housed in the frame 16 in a movable manner in right and left directions.

A rear side plate 16*a* of the frame 16 is provided with a paper introduction port (not shown), while a front side plate 16*b* is provided with a paper discharge port (not shown). The recording paper fed by the paper feeder 2 is introduced through the paper introduction port into the inside of the frame 16, conveyed forward by the paper conveying mechanism 14 and discharged through the paper discharge port.

A platen 17 having a plurality of ribs is mounted on a bottom surface of the frame 16. Within the frame 16, image formation is performed by the recording head 10 on the recording paper moving on the platen 17.

Ink cartridges 21*a*-21*d* for four colors of ink mounted on a cartridge mounting portion 20 provided on a front side of the frame 16 are connected to the recording head 10 through four flexible ink tubes 22*a*-22*d* passing through the inside of the frame 16. The four colors of ink are supplied to the recording head 10 through the four flexible ink tubes 22*a*-22*d*.

Two flexible print circuits (FPC's) 23 and 24 are provided in the frame 16. The FPC 23 extends integrally with the two ink tubes 22*a* and 22*b*, and is connected to the recording head 10. The FPC 24 extends integrally with the two ink tubes 22*c* and 22*d*, and is connected to the recording head 10. A plurality of signal lines are provided on the FPC's 23 and 24 so as to electrically connect an electronic control device and the recording head 10.

The guide mechanism 12 includes a guide shaft 25 and a guide rail 26. The guide shaft 25 extends in right and left directions in the drawing of FIG. 2 in a rear portion inside the frame 16. Right and left ends of the guide shaft 25 are connected to a right side plate 16*d* and a left side plate 16*c* of the frame 16, respectively. The guide rail 26 extends in the right and left directions in a front portion inside the frame 16. A rear end portion of the carriage 11 is slidably penetrated by the guide shaft 25, while a front end portion of the carriage 11 is slidably joined with the guide rail 26.

The carriage moving mechanism 13 includes a carriage motor 30, a drive pulley 31, a driven pulley 32 and a belt 33. The carriage motor 30 is mounted on a rear face of the right end portion of the rear side plate 16*a* of the frame 16. The drive pulley 31 is rotatingly driven by the carriage motor 30. The driven pulley 32 is rotatably supported by a left end portion of the rear side plate. The belt 33 is wound around the pulleys 31 and 32 and fixed to the carriage 11. A carriage movement encoder 39 for detecting a moving amount of the carriage 11, in other words, for detecting a position of the recording head 10, is provided in the vicinity of the carriage motor 30.

The paper conveying mechanism 14 includes a conveying roller 41, a paper discharge roller 45 and a paper conveying motor 40 that rotatingly drives the conveying roller 41, the paper discharge roller 45 and the paper feed roller 2*d*. A DC motor is employed as the paper conveying motor 40 in the present embodiment.

The paper conveying motor 40 is mounted on a right face of a part of the left side plate 16*c* which extends rearward beyond the rear side plate 16*a*. The conveying roller 41 is disposed under the guide shaft 25 inside the frame 16 such that an axial direction of the conveying roller 41 is in the right and left direction. The conveying roller 41 has a right end and a left end rotatably supported by the right side plate 16*d* and the left side plate 16*c*, respectively. The paper discharge roller 45 is disposed in a front portion inside the frame 16 such that an axial direction of the paper discharge roller 45 is in the right and left direction. The paper discharge roller 45 has a right end and a left end rotatably supported by the right side plate 16*d* and the left side plate 16*c*, respectively.

The conveying roller 41 is rotatingly driven by the paper conveying motor 40 through a belt 44, which is wound around a driven pulley 43 connected to the left end of the conveying roller 41 and a drive pulley 42 rotatingly driven by the paper conveying motor 40. The paper discharge roller 45 is rotatingly driven through a belt 48, which is wound around a driven pulley 47 connected to the left end of the paper discharge roller 45 and an intermediate pulley 46 provided integrally with the driven pulley 43. Accordingly, when the paper conveying motor 40 is rotated, the paper feed roller 2*d*, the conveying roller 41 and the paper discharge roller 45 are rotated at the same time to convey the recording paper.

A paper conveyance encoder 50 is constituted by an encoder disk 51 fitted to the driven pulley 43 and a photo interrupter 52. The photo interrupter 52 has a light emitting portion and a light receiving portion sandwiching the encoder disk 51 therebetween, and is mounted on the left side plate 16*c*. An electronic control device 70 (see FIG. 4) detects a moving amount (a conveying amount) of the recording paper with respect to the recording head 10 based on a detected signal from the paper conveyance encoder 50 (the photo interrupter 52), and thereby controls the driving of the paper conveying motor 40.

A media sensor 68 capable of detecting a front edge, a rear edge, side edges of the recording paper, or the like is provided in a left end portion of the recording head 10. Specifically, the media sensor 68, which is an optical sensor including a light emitting portion (a light emitting element) and a light receiving portion (a light receiving element), is attached facing downward to a sensor attachment portion 10*e* extending leftward from the recording head 10.

A regist sensor 69 (see FIG. 4) capable of detecting presence/absence of paper, the front edge or the rear edge is provided upstream from the media sensor 68 in the paper conveying direction, i.e., at a front end portion of an upper cover of the paper feeder 2 constituting a conveying path.

The regist sensor 69 may be constituted, for example, by a mechanical sensor having a detection probe extending into the paper conveying path and being rotated by the paper during conveyance, a photo interrupter having a light emitting portion and a light receiving portion for detecting rotation of the detection probe, and a torsion spring for biasing the detection probe toward the paper conveying path.

The maintenance mechanism 15 includes a wiper blade 15*a* for wiping a nozzle opening surface 10*f* of the recording head 10, two caps 15*b* each capable of sealing two out of four rows of ink nozzles 10*a*-10*d*, and a drive motor 15*c* for opening/closing the caps 15*b*.

The wiper blade 15*a*, the caps 15*b* and the drive motor 15*c* are fixed to an undersurface of a right portion of a bottom plate of the frame 16 through an attachment board 15*d*.

The recording head 10 is provided with four rows of ink nozzles 10*a*-10*d*, that is, the nozzle opening surface 10*f* opening downward along the gravity direction. By ejecting four colors of ink (black, cyan, yellow and magenta) through the ink nozzles 10*a*-10*d* toward the recording paper as the recording medium, an image is formed on the recording medium.

The caps 15*b* and the rows of ink nozzles 10*a*-10*d*, which are provided under the recording head 10, are indicated by dashed lines at positions seen through the recording head 10 in FIG. 2. Each of the four rows of ink nozzles 10*a*-10*d* is constituted by, for example, 150 ink nozzles (not shown) aligned in the conveying direction of the recording paper for ejecting ink of the same color. The four rows of ink nozzles are arranged in order in the moving direction of the carriage 11.

Figure 4:
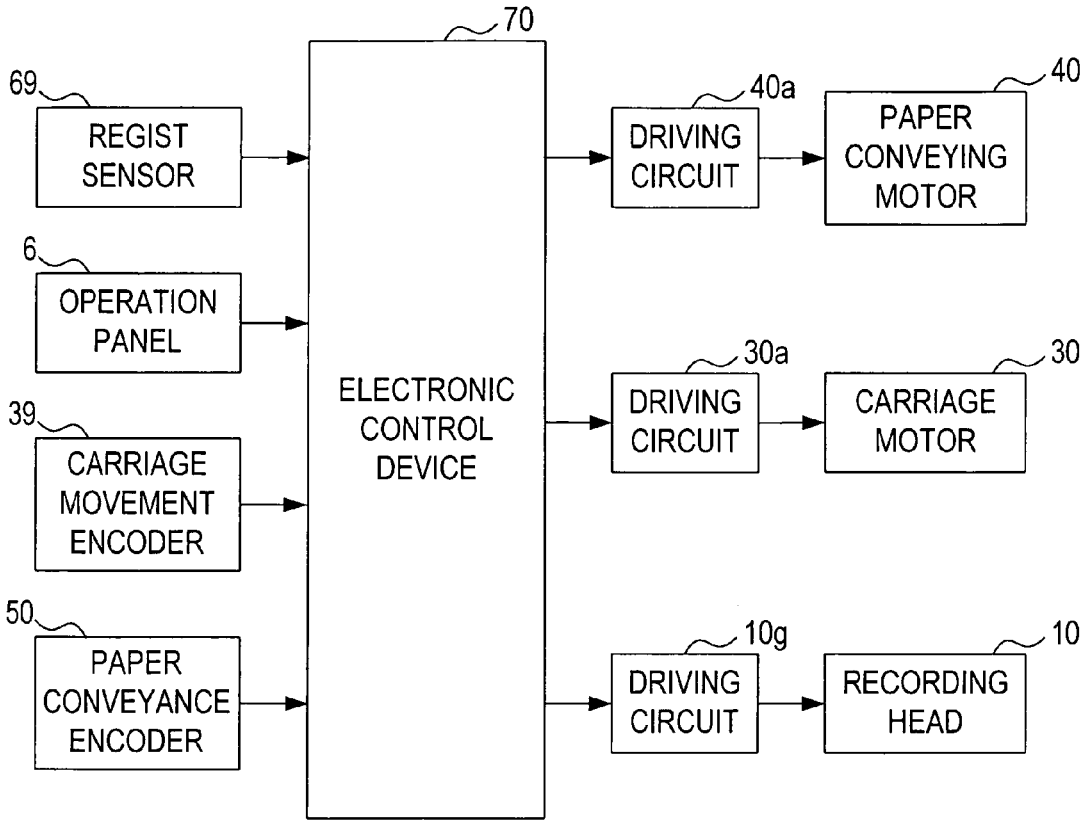
FIG. 4 is a block diagram showing an electric system of the multifunction apparatus according to the embodiments of the present invention.

A control system of the printer 3 will now be described based on the block diagram shown in FIG. 4.

The operation panel 6, the carriage movement encoder 39 and the regist sensor 69 and others are connected to an input side of the electronic control device 70. A driving circuit 40*a* for driving the paper conveying motor 40, a driving circuit 30*a* for driving the carriage motor 30 and a driving circuit 10*g* for ejecting ink from desired rows of ink nozzles among the rows of ink nozzles 10*a*-10*d* are connected to an output side of the electronic control device 70.

The electronic control device 70 is constituted by a known microcomputer including a CPU (Central Processing Unit), a ROM (Read Only Memory), a RAM (Random Access Memory) and an EEPROM (Electronically Erasable and Programmable Read Only Memory). The electronic control device 70 controls various components such that a recording operation and an intermittent conveying operation are repeated in turn, and thereby a desired image or the like is printed (or formed) on the recording paper P. The recording operation is an operation for ejecting ink while moving the recording head 10 in a main scanning direction, and the intermittent conveying operation is an operation for conveying the recording paper P by a specified amount in a sub scanning direction (a direction perpendicular to the main scanning direction).

A conveying amount of the recording paper P while a recording process (a printing process) is performed is determined by the conveying roller 41 or the paper discharge roller 45. Specifically, the conveying amount of the recording paper P is determined by the conveying roller 41 when the recording paper P contacts the conveying roller 41, while the conveying amount of the recording paper P is determined by the paper discharge roller 45 when the recording paper P contacts only the paper discharge roller 45, i.e., after the rear edge of the recording paper P goes through the conveying roller 41.

The printing process of the printer 3 will be described hereinafter.

Figure 5:
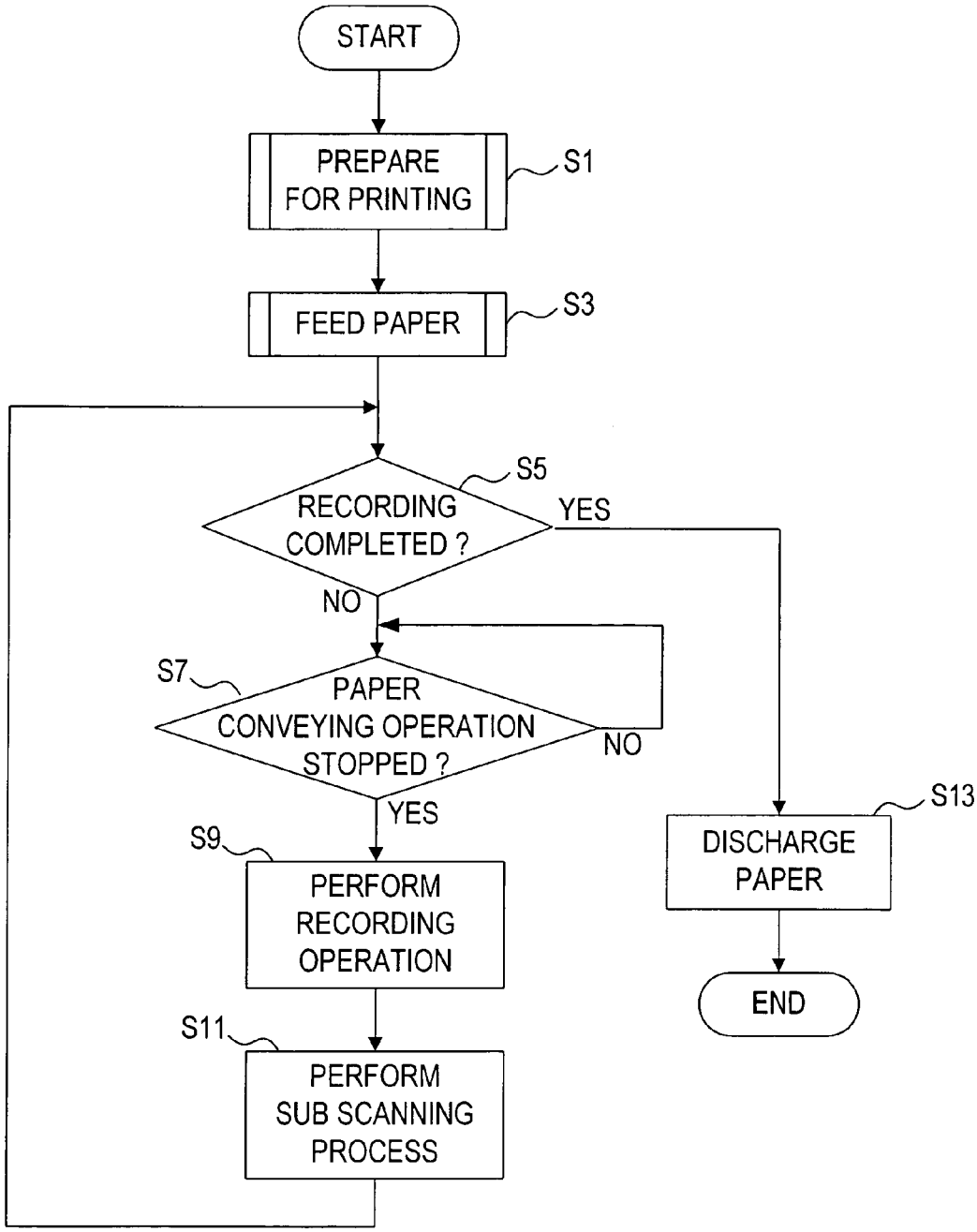
FIG. 5 is a flowchart showing a main control flow of a printer according to a first embodiment of the present invention.

FIG. 5 is a main control flowchart schematically indicating the recording process of the serial recording type inkjet printer 3 in the present embodiment. When the recording process is started, a preparation for printing is performed first (S1). When the preparation for printing is completed, the paper conveying motor 40 is started to rotate and the recording paper P is fed toward the recording head 10 (S3). The preparation for printing includes moving the carriage 11 from a waiting position to a recording start enable position, developing recording data in the RAM and setting various setting values necessary for recording.

Then, it is determined whether or not a recording (printing) operation for data to be recorded (printed) has been completed (S5). When it is determined that the recording operation has been completed (S5: YES), the recording paper P is discharged from the printer 3 and the recording operation is terminated (S13).

When it is determined that the recording operation has not been completed (S5: NO), it is determined whether or not the intermittent conveying operation of the recording paper P is stopped (S7).

When it is determined that the intermittent conveying operation of the recording paper P is stopped (S7: YES), the recording operation of ejecting ink from the recording head 10 toward the recording paper P while making the carriage 11 scan in the main scanning direction is performed (S9). Also, a sub scanning process of minutely vibrating the recording paper P in the paper conveying direction (i.e., in the sub scanning direction) is performed (S11). Either of the recording operation (S9) and the sub scanning process (S11) is not performed during the intermittent conveying operation.

The intermittent conveying operation, and the recording operation and the sub scanning process are repeatedly performed in turn until the recording (printing) operation for the data to be recorded (printed) has been completed, that is, until the desired image is recorded on the recording paper P.

The sub scanning process performed in S11 will now be described.

Figure 6:
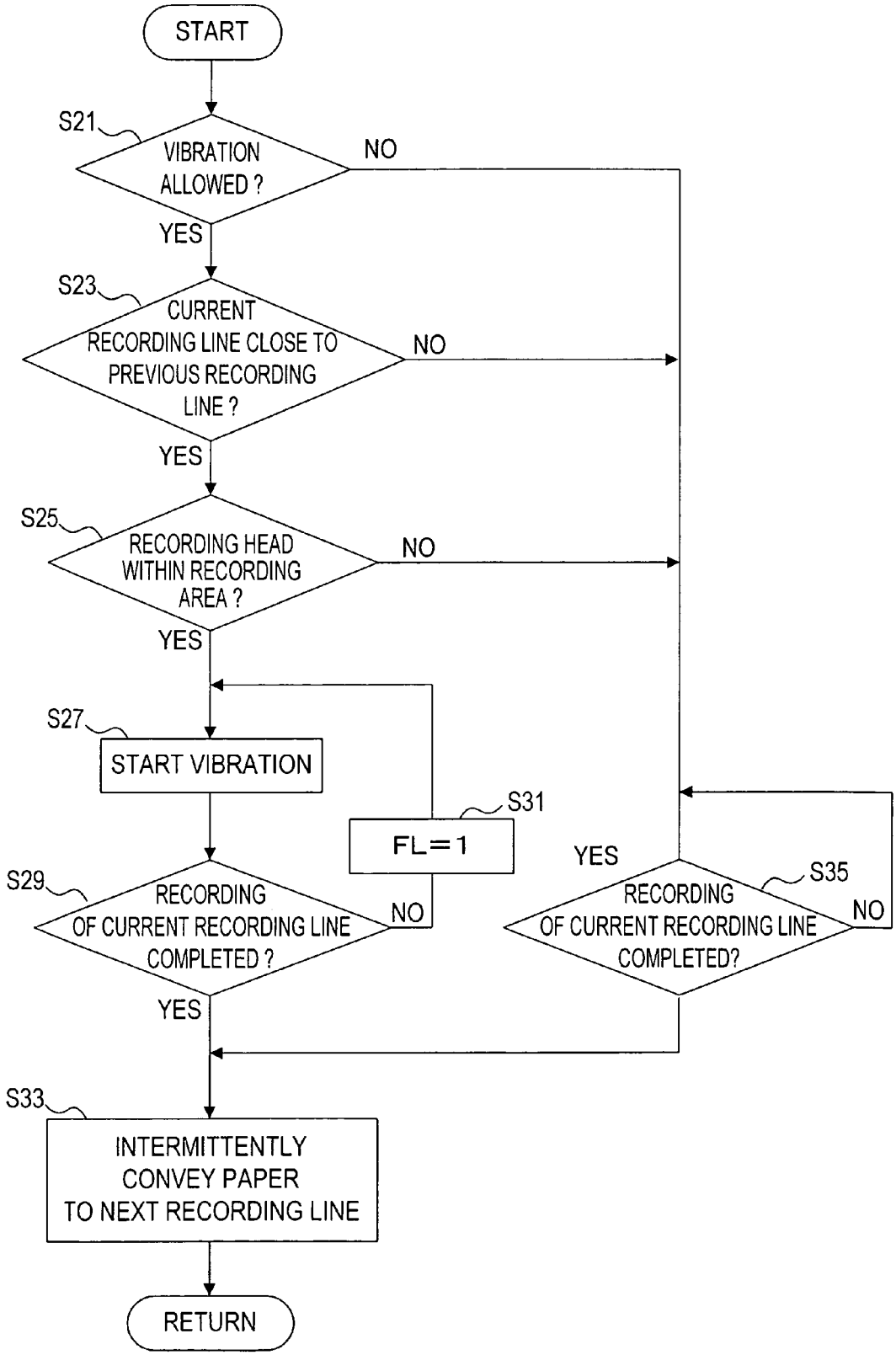
FIG. 6 is a flowchart showing a sub scanning control process flow of the printer according to the first embodiment of the present invention.

FIG. 6 is a sub scanning flowchart schematically showing the sub scanning process. When the sub scanning process is started, it is first determined whether or not it is necessary to minutely vibrate the recording paper P in the paper conveying direction (i.e., in the sub scanning direction), that is, whether or not vibration should be allowed (S21).

In the printer 3 of the present embodiment, vibration is not allowed when the data to be recorded is character data (such a case is hereinafter referred to as the "text recording mode") or when the conveying amount during one intermittent conveying operation is equal to or more than a specified conveying amount, e.g., 85 μm or 1/300 inches (such a case is hereinafter referred to as the "recording mode with a low sub scanning resolution).

Vibration is allowed when the data to be recorded is image data other than character data (such a case is hereinafter referred to as the "image recording mode") and/or when the conveying amount during one intermittent conveying operation is less than the specified conveying amount, e.g., 85 μm or 1/300 inches (such a case is hereinafter referred to as the "recording mode with a high sub scanning resolution).

When vibration is allowed (S21: YES), it is determined whether or not a recording line to be currently recorded is close to a previous recorded line based on image data (S23). Specifically, it is determined whether or not the recording line to be currently recorded is close to the previous recorded line as a normal recording operation.

When data to be recorded includes, for example, a white line in the main scanning direction, the recording line to be currently recorded is separate from the previous recorded line as a normal recording operation, and, therefore, it is determined NO in S23. When data to be recorded does not include a white line or the like in the main scanning direction and continues in the sub scanning direction, the recording line to be currently recorded is close to the previous recorded line as a normal recording operation, and, therefore, it is determined YES in S23.

When it is determined that the recording line to be currently recorded is close to the previous recorded line (S23: YES), it is then determined whether or not the recording head 10 is within a recording area, i.e., an area in which ejection of ink should be performed (S25).

When it is determined that the recording head 10 is within the recording area (S25: YES), a vibration is started (S27). During the vibration, the conveying roller 41 and the paper discharge roller 45 are vibratingly rotated in forward and reverse rotating directions, and thereby the recording paper P is minutely vibrated in the paper conveying direction (i.e., in the sub scanning direction). A detailed description of the vibration will be provided later.

Then, it is determined whether or not the recording head 10 is out of the recording area (S29). When it is determined that the recording head 10 is still in the recording area, in other words, when the recording head 10 ejects ink toward the recording paper P (S29: NO), a vibration flag is set to "1" and the vibration is continued.

When it is determined that the recording head 10 is out of the recording area and the recording of the current recording line has been completed (S29: YES), the recording paper P is conveyed to a next recording line (S33). Then, the sub scanning process is terminated and the present process returns to the main control flow.

When vibration is not allowed (S21: NO), when it is determined that a recording line to be currently recorded is not close to the previous recorded line (S23: NO), or when it is determined that the recording head 10 is out of the area (S25: NO), it is then determined whether or not the recording of the current recording line has been completed (S35).

When it is determined that the recording of the current recording line has been completed (S35: YES), the recording paper P is conveyed to a next recording line (S33). Then, the sub scanning process is terminated and the present process returns to the main control flow.

The vibration performed in S27 will now be described. FIG. 7 shows a vibration process flow schematically indicating a vibration process. When the vibration process flow is started, it is first determined whether or not the vibration flag is "1" (S41).

When it is determined that the vibration flag is not "1" (S41: NO), that is, when the vibration process flow is first started, "0" is input as an initial value in each of a total moving amount (Σctrlval) and a threshold (Threshold_out) (S43). A moving amount (Σctrlval) of the recording paper P from when the vibration process flow was started at the previous time until the current time is integrated to the total moving amount ("0" in this case) calculated when the vibration process flow was started at the previous time. Then, the integrated value is stored as a total moving amount (Σctrlval) when the vibration process flow is started at the current time (S45).

When it is determined that the vibration flag is "1" (S41: YES), that is, when the vibration process flow has been started twice or more, a moving amount (ctrlval) of the recording paper P from when the vibration process flow was started at the previous time until the current time is integrated to the total moving amount (Σctrlval) calculated when the vibration process flow was started at the previous time. Then, the integrated value is stored as a total moving amount (Σctrlval) when the vibration process flow is started at the current time (S45).

The total moving amount (Σctrlval) here means a total moving amount of the recording paper P with reference to the time when the conveying operation of the recording paper P is stopped. The threshold (Threshold_out) here means a threshold for digitizing a multi-valued random signal generated based on a random seed into +1 and −1.

Subsequently, the total moving amount (Σctrlval) obtained in S45 and an integrated value (Σoprval) of a digitized random signal (oprval) are compared (S47). Since the total moving amount (Σctrlval) and the digitized random signal (oprval) are different in unit (dimension), the total moving amount (Σctrlval) is multiplied by a specified coefficient α in the present embodiment. By this, the unit (dimension) of the total moving amount (Σctrlval) becomes the same as the unit (dimension) of the digitized random signal (oprval), and comparison of the total moving amount (Σctrlval) and the digitized random signal (oprval) can be performed.

The digitized random signal (oprval) means a value digitized based on the multi-valued random signal generated based on the random seed, i.e., +1 or −1, and the integrated value (Σoprval) of the digitized random signal (oprval) means a value obtained by integrating each digitized random signal (oprval) determined each time the vibration process flow is started.

When a value obtained by multiplying the total moving amount (Σctrlval) by α is larger than the integrated value (Σoprval) of the digitized random signal (oprval), and also the difference between the values is larger than a predetermined value (jdg_val), a value obtained by adding a predetermined value (Threshold_delta) to a threshold (Threshold_out) determined when the vibration process flow was started at the previous time is regarded as a threshold (Threshold_out) at the current time (S49). Then, a new multi-valued random signal (rndval) is generated based on a random seed (S53).

When the value obtained by multiplying the total moving amount (Σctrlval) by α is smaller than the integrated value (Σoprval) of the digitized random signal (oprval), and also the difference between the values is larger than a predetermined value (jdg_val), a value obtained by subtracting a predetermined value (Threshold_delta) from a threshold (Threshold_out) determined when the vibration process flow was started at the previous time is regarded as a threshold (Threshold_out) at the current time (S51). Then, a new multi-valued random signal (rndval) is generated based on a random seed (S53).

When the value obtained by multiplying the total moving amount (Σctrlval) by α is equal to the integrated value (Σoprval) of the digitized random signal (oprval), the threshold (Threshold_out) determined when the vibration process flow was started at the previous time is regarded as a threshold (Threshold_out) at the current time (S51). Then, a new multi-valued random signal (rndval) is generated based on a random seed (S53).

Subsequently, the newly generated multi-valued random signal (rndval) and the newly determined threshold (Threshold_out) are compared (S55). If the multi-valued random signal (rndval) is larger than the threshold (Threshold_out) (S55: YES), the digitized random signal (oprval) is determined as +1 (S57), while if the multi-valued random signal (rndval) is not larger than the threshold (Threshold_out) (S55: NO), the digitized random signal (oprval) is determined as −1 (S59).

In the present embodiment, when the digitized random signal (oprval) is +1, a specified voltage (+30 V in the present embodiment) is applied to the paper conveying motor 40 for a specified time (1 ms in the present embodiment) so as to move the recording paper P in a discharging direction (a forward rotating direction). Also, when the digitized random signal (oprval) is −1, a specified voltage (−30 V in the present embodiment) is applied to the paper conveying motor 40 for a specified time (1 ms in the present embodiment) so as to move the recording paper P in a direction returning toward the paper feed roller 2*d* (a reverse rotating direction). As a result, the recording paper P is minutely vibrated.

Subsequently, a value obtained by adding the digitized random signal (oprval) determined at the current time to the integrated value (Σoprval) of the digitized random signal (oprval) until the previous time is stored as a new integrated value (Σoprval) of the digitized random signal (oprval) (S61).

Then, the vibration process flow is terminated, and the present process returns to the main control flow.

Features of the printer 3 of the present embodiment will be described hereinafter.

According to the present embodiment, when ink is ejected from the recording head 10 toward the recording paper P, the recording paper P is minutely vibrated to thereby be vibratingly displaced relatively with respect to the recording head 10. Accordingly, while ink is ejected from the recording head 10 toward the recording paper P in order to form an image, it is possible to minutely scatter deposit points (landing points) of ink droplets.

Accordingly, even if the conveying amount differs at each conveyance, banding may be invisible. Thus, appearance of banding can be prevented without employing an expensive motor or a component with a high accuracy, or increasing dimensional accuracies of components from the current level. It is, therefore, possible to securely prevent appearance of banding even when individual printers have variations.

Figure 8:
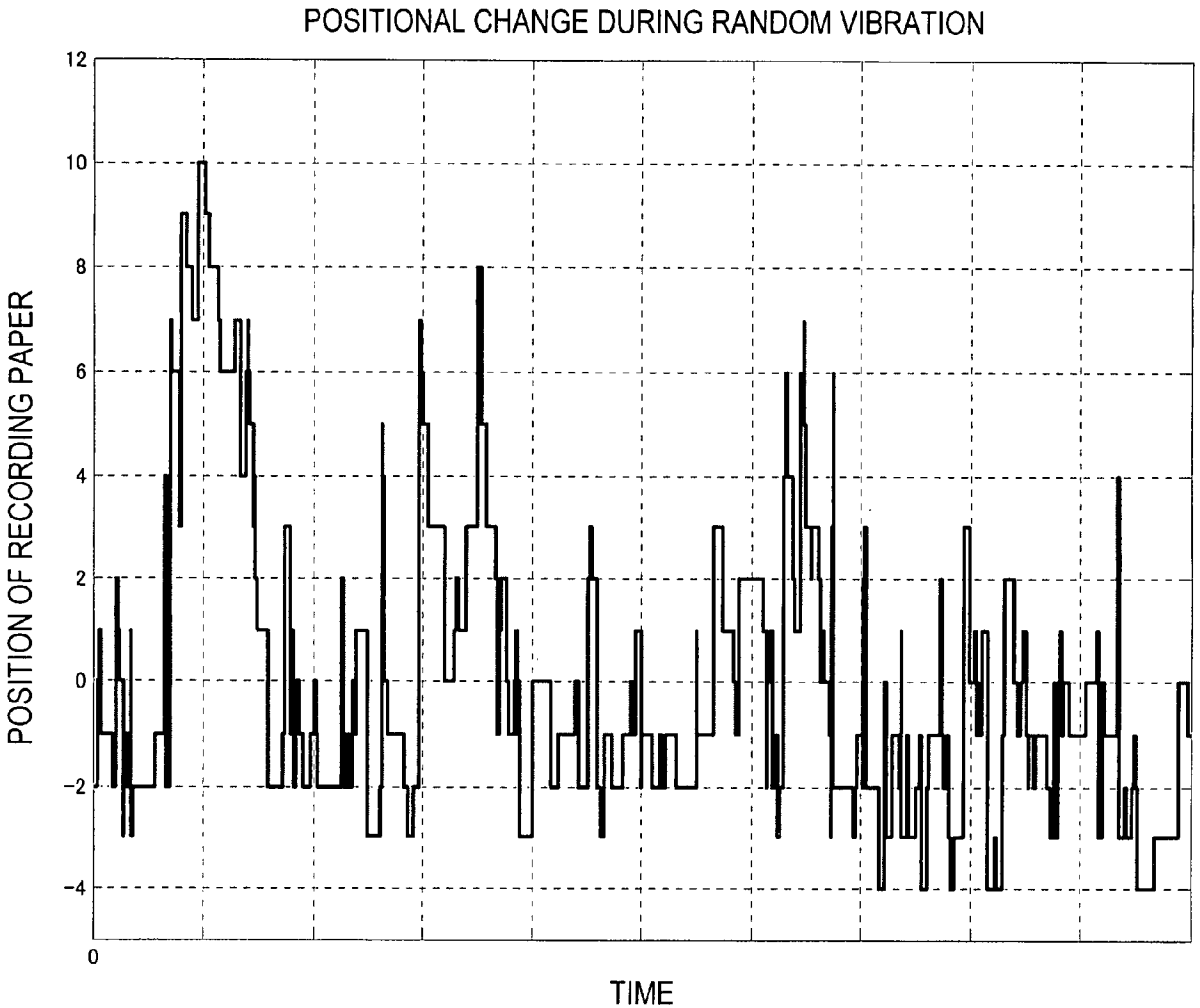
FIG. 8 is a diagram showing positional changes of recording paper in the printer according to the first embodiment of the present invention.
Figure 9:
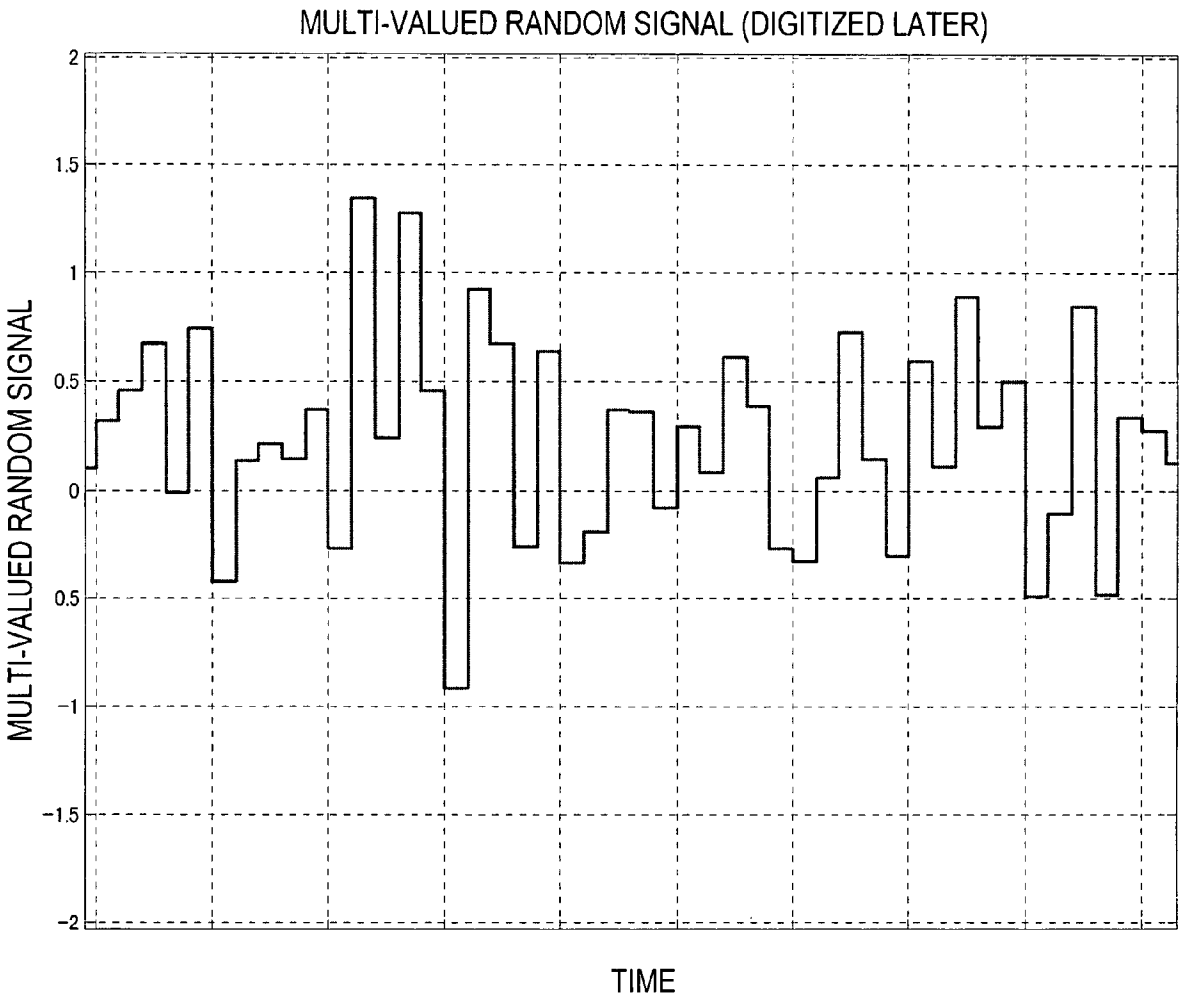
FIG. 9 is a diagram showing changes in a multi-valued random signal in the printer according to the first embodiment of the present invention.
Figure 10:
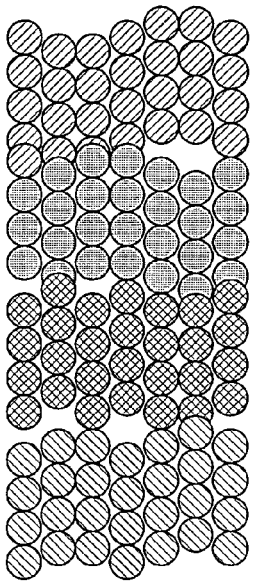
FIG. 10 is a diagrammatic view showing an effect of the printer according to the first embodiment of the present invention.

FIG. 8 shows changes in the moving amount (ctrlval) of the recording paper P using a position at which the conveyance of the recording paper P is stopped as a reference point (0). FIG. 9 shows changes in a multi-valued random signal (rndval) before digitization. In the present embodiment, when the paper conveying motor 40 is driven by using a digitized signal based on a multi-valued random signal, for example, as shown in FIG. 9, the position of the recording paper P varies in accordance with the passage of time, for example, as shown in FIG. 8. Then, deposit points (landing points) of ink droplets are minutely scattered, so that banding is invisible as shown in FIG. 10 in the present embodiment.

When printers have substantial variations or when the state of conveyance of the recording paper P changes, the recording paper P vibrated in the same manner may be moved more than necessary and may cause appearance of more banding.

In the present embodiment, however, a threshold (Threshold_out) for determining a digitized random signal (oprval) from a multi-valued random signal (rndval) is changed based on a total moving amount (Σctrlval), and thereby a vibration displacement pattern is consecutively changed. Accordingly, even when printers have substantial variations or when the state of conveyance of the recording medium changes, it is possible to minutely scatter deposit points (landing points) of ink droplets in accordance with such conditions, and thereby to prevent appearance of banding more securely.

Changes in the state of conveyance of the recording paper P include changes in the direction of the conveying force acting on the recording paper P during conveyance, changes in the acting point of the conveying force and an inherent curling tendency of the recording paper P.

Figure 11A:
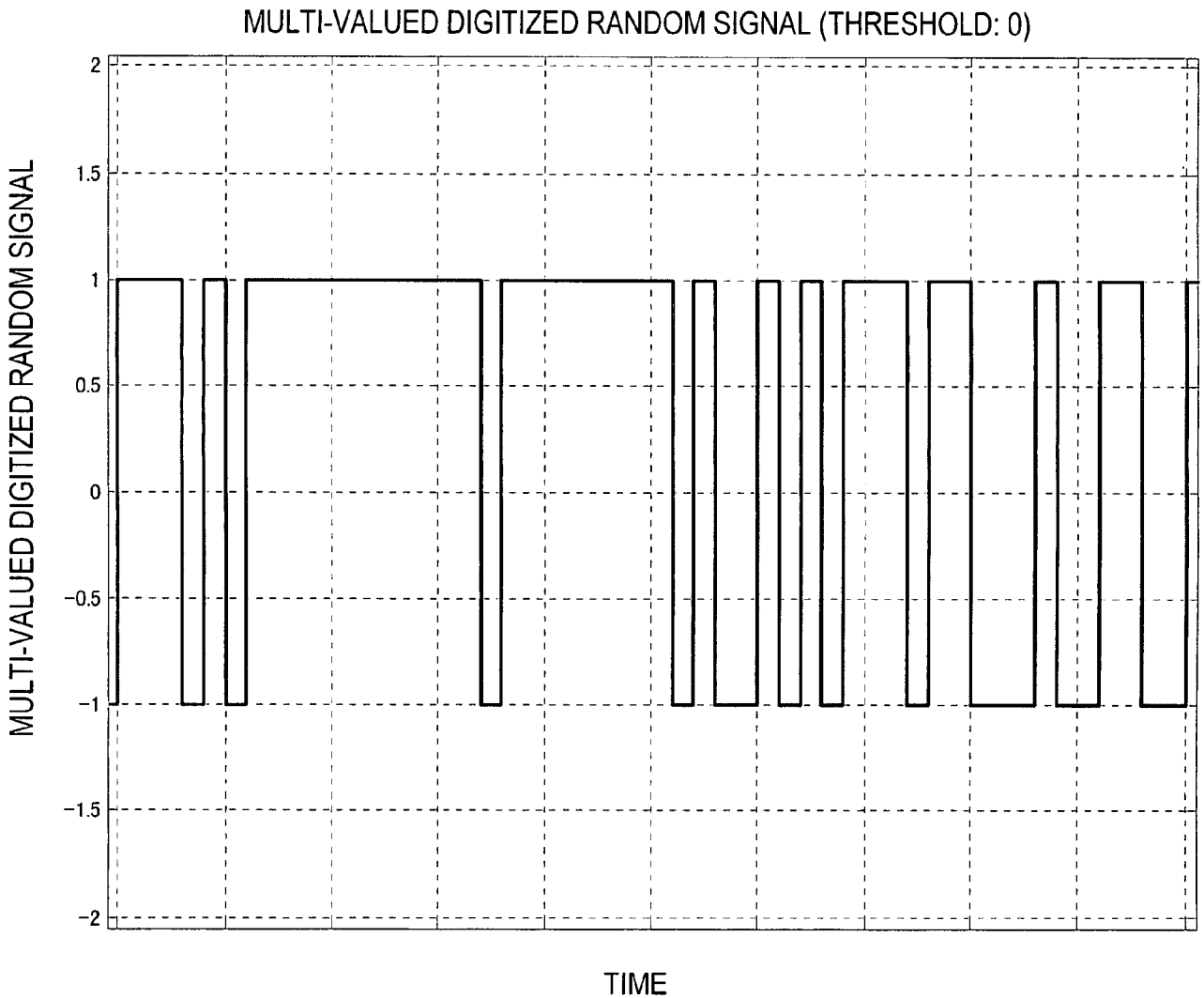
FIGS. 11A and 11B are diagrams showing changes in the respective random signals after digitization in the printer according to the first embodiment of the present invention.
Figure 11B:
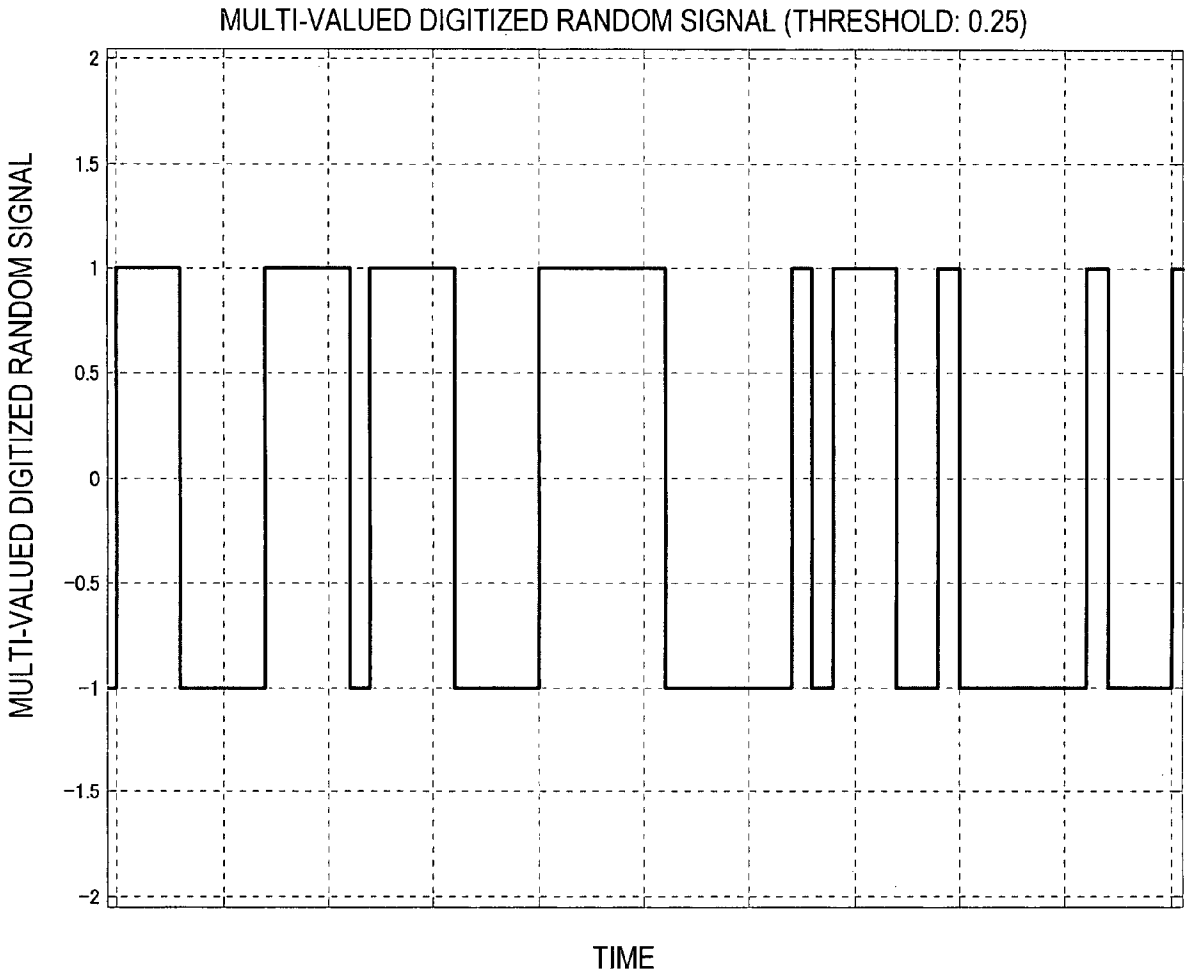

FIG. 11A is a diagram showing a digitized random signal (oprval) in the case of setting the threshold (Threshold_out) to 0, while FIG. 11B is a diagram showing a digitized random signal (oprval) in the case of setting the threshold (Threshold_out) to 0.25. As clearly shown in FIGS. 11A and 11B, the moving amount of the recording paper P changes in accordance with the change of the threshold (Threshold_out).

According to the present embodiment, the recording paper P is vibratingly displaced relatively with respect to the recording head 10 based on a multi-valued random signal. In this case, occurrence of periodicity in deposit points of ink droplets can be securely prevented as compared with the case of vibratingly displacing the recording paper P by using, for example, a sinusoidal wave. It is, therefore, possible to securely scatter deposit points of ink droplets, and thereby to securely prevent appearance of banding.

In the case of vibration displacement based on a multi-valued random signal, the vibration displacement pattern may be changed by changing the threshold (Threshold_out) more easily than in the case of vibration displacement by using, for example, a sinusoidal wave.

Accordingly, even when printers have substantial variations or when the state of conveyance of the recording medium changes, it is possible to minutely scatter deposit points (landing points) of ink droplets in accordance with such conditions, and thereby to prevent appearance of banding more securely.

Banding is likely to appear more clearly in the case of recording image data compared with the case of recording character data (text data).

In view of the above, vibration displacement is not performed when data to be recorded is character data, while vibration displacement is performed at least one of when data to be recorded is image data and when the resolution in the sub scanning direction is high in the present embodiment. It is, therefore, possible to prevent appearance of banding instead of performing unnecessary vibration process.

The recording paper P is vibratingly displaced relatively with respect to the recording head 10 by vibrating the conveying roller 41 and the paper discharge roller 45 in the respective rotating directions in the present embodiment. Accordingly, vibration displacement can be achieved using existing components without providing additional components for vibratingly displacing the recording paper P relatively with respect to the recording head 10. It is, therefore, possible to securely prevent appearance of banding while preventing an increase in the manufacturing cost of the printer 3.

Second Embodiment

Figure 12:
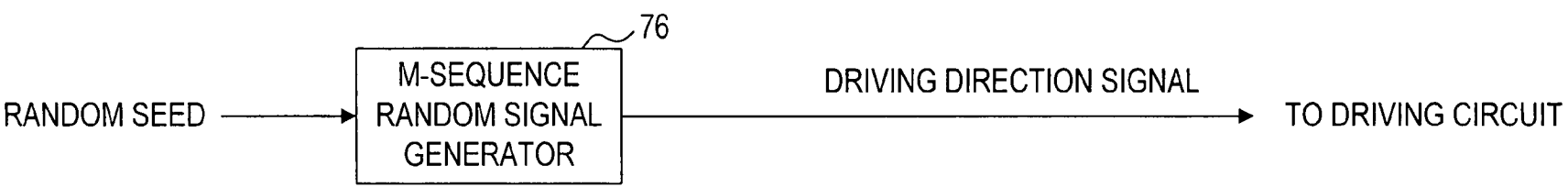
FIG. 12 is a block diagram showing a circuit for generating a signal for vibration in a printer according to a second embodiment of the present invention.

In the first embodiment, the recording paper P is vibratingly displaced relatively with respect to the recording head 10 based on a multi-valued random signal. In the present embodiment, the recording paper P is vibratingly displaced relatively with respect to the recording head 10 based on a already digitized random signal generated by an M-sequence random signal generator 76, as shown in FIG. 12.

Occurrence of periodicity in deposit points of ink droplets can be securely prevented also in the present embodiment in the same manner as in the first embodiment, as compared with the case of vibratingly displacing the recording paper P by using, for example, a sinusoidal wave. It is, therefore, possible to securely scatter deposit points of ink droplets, and thereby to securely prevent appearance of banding.

Amplitude of the vibration displacement can be uniquely determined based on the M-sequence random signal. It is, therefore, possible to securely prevent occurrence of periodicity in deposit points of ink droplets, as compared with the case of the vibration displacement based on a multi-valued random signal while preventing an increase in the manufacturing cost of the printer 3.

Figure 13:
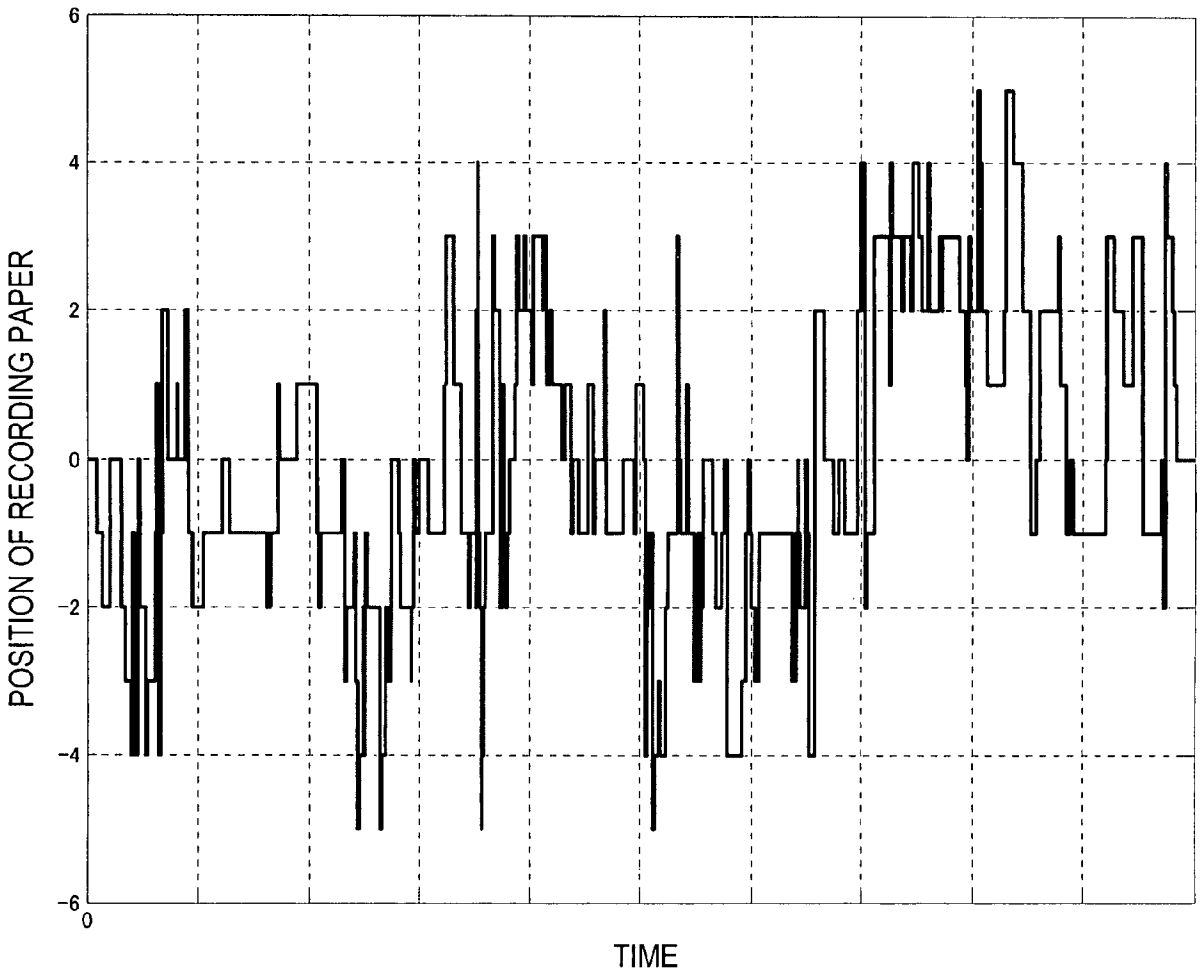
FIG. 13 is a diagram showing positional changes of recording paper in the printer according to the second embodiment of the present invention.
Figure 14:
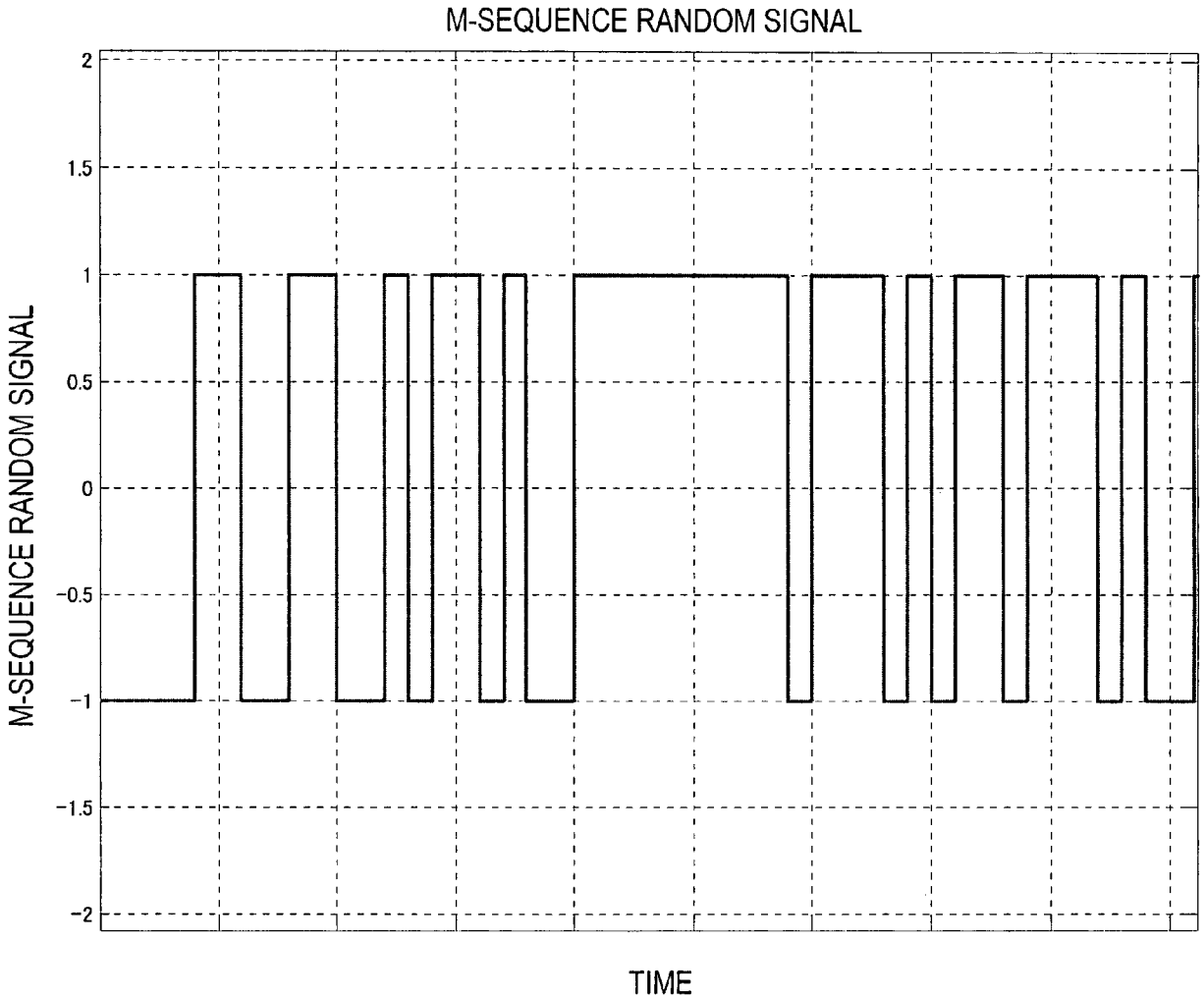
FIG. 14 is a diagram showing changes in an M-sequence random signal in the printer according to the second embodiment of the present invention.

FIG. 13 shows changes in the moving amount (ctrval) of the recording paper P in the case of using a position at which the conveyance of the recording paper P is stopped as a reference point (0). FIG. 14 shows changes in an already digitized random signal (oprval) by the M-sequence random signal generator. As clearly shown by FIG. 13 and FIG. 14, deposit points (landing points) of ink droplets are minutely scattered, so that banding is invisible in the present embodiment.

Third Embodiment

In the first embodiment, the threshold (Threshold_out) for determining a digitized random signal (oprval) from a multi-valued random signal (rndval) is changed based on the total moving amount (Σctrlval) of the recording paper P, and thereby the vibration displacement pattern is changed. In contrast, vibration is stopped when the total moving amount (Σctrlval) of the recording paper P exceeds a predetermined amount in the present embodiment.

Figure 15:
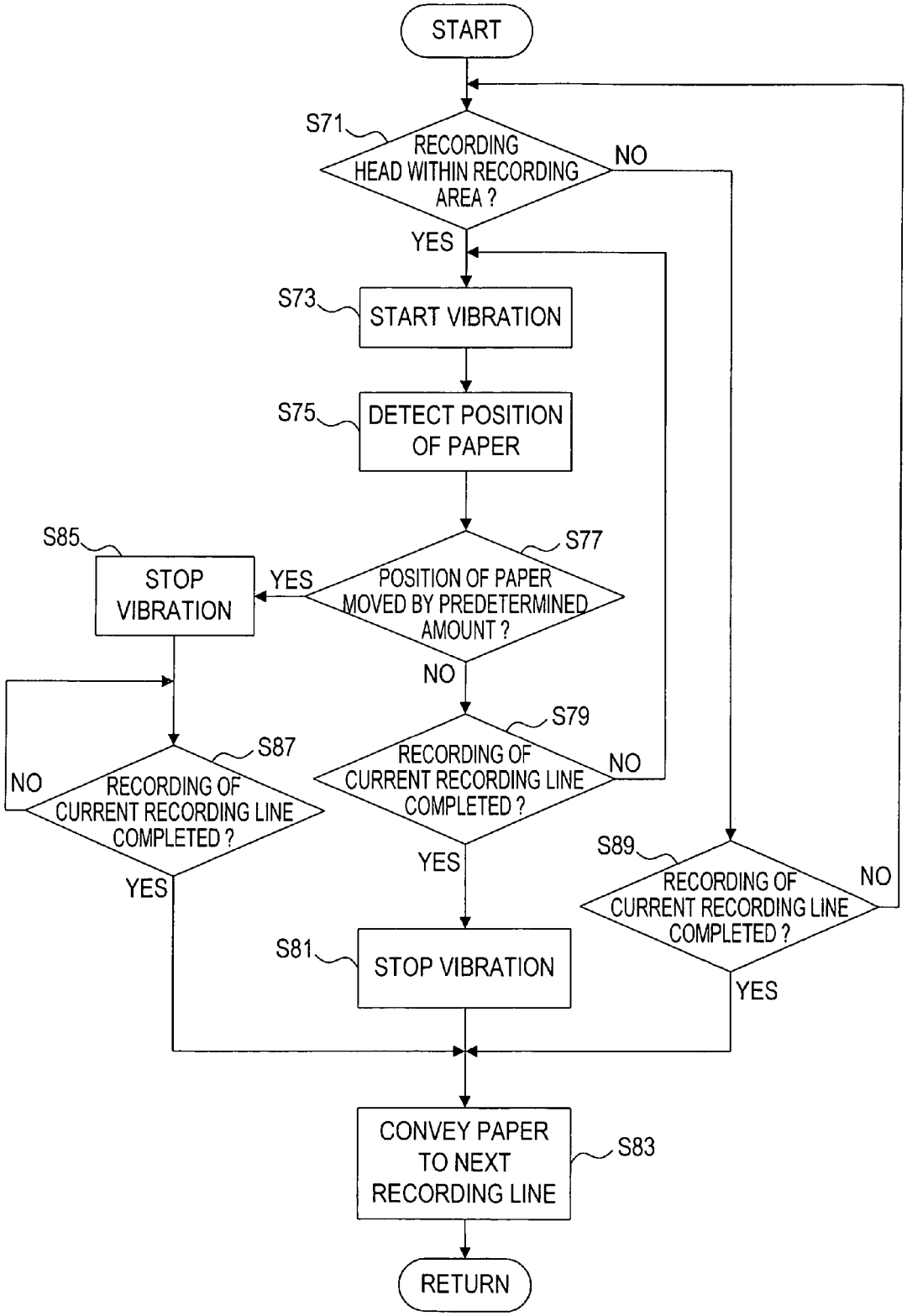
FIG. 15 is a flowchart showing a sub scanning control process flow of a printer according to a third embodiment of the present invention.

FIG. 15 shows a sub scanning flow schematically illustrating a sub scanning process in the present embodiment. When the sub scanning process is started, it is first determined whether or not the recording head 10 is within a recording area (S71). When it is determined that the recording head 10 is within the recording area (S71: YES), vibration is started (S73). During the vibration, the conveying roller 41 and the paper discharge roller 45 are vibratingly rotated in forward and reverse rotating directions, and the recording paper P is minutely vibrated in the paper conveying direction (i.e., in the sub scanning direction).

When it is determined that the recording head 10 is not in the recording area (S71: NO), it is then determined whether or not recording of the current recording line has been completed (S89).

When it is determined that the recording of the current recording line has been completed (S89: YES), the recording paper P is conveyed to a next recording line (S83). Then, the sub scanning process is terminated and the present process returns to the main control flow. When it is determined that recording of the current recording line has not been completed (S89: NO), the present process returns to S71.

When vibration is started (S73), a current position of the recording paper P, i.e., a total moving amount (Σctrlval), is detected based on an output of the paper conveyance encoder 50 (S75). Then, it is determined whether or not the current position of the recording paper 50 has moved a predetermined amount from a position at which the conveyance was stopped, i.e., whether or not the total moving amount (Σctrlval) exceeds the predetermined amount (S77).

When it is determined that the total moving amount (Σctrlval) is less than the predetermined amount (S77: NO), it is then determined whether or not the recording head 10 is out of the recording area, i.e., whether or not the recording of the current recording line has been completed (S79).

When it is determined that the recording of the current recording line has been completed (S79: YES), vibration is stopped (S81), and the recording paper P is conveyed to the next recording line (S83). Then, the sub scanning process is terminated, and the present process returns to the main control flow.

When it is determined that the recording of the current recording line has not been completed (S79: NO), the present process returns to S73.

When it is determined that the total moving amount (Σctrlval) exceeds the predetermined amount (S77: YES), vibration is stopped (S85). Then, it is determined whether or not the recording head is out of the recording area, i.e., whether or not the recording of the current recording line has been completed (S87).

When it is determined that the recording of the current recording line has been completed (S87: YES), the recording paper P is conveyed to the next recording line (S83). Then, the sub scanning process is terminated, and the present process returns to the main control flow.

A feature of the present embodiment will now be described below.

When printers have substantial variations or when the state of conveyance of the recording paper P changes, the recording paper P vibrated in the same manner may be moved more than necessary and may cause appearance of more banding, as described above.

In the present embodiment, however, when the total moving amount (Σctrlval) of the recording paper P exceeds a predetermined amount, vibration is stopped. It is, therefore, possible to securely prevent appearance of banding.

As clarified by the above description of the feature, the present embodiment is especially advantageous when applied to a case in which vibration is performed with a uniquely determined vibration displacement, such as vibration based on an M-sequence random signal or a sinusoidal wave.

Fourth Embodiment

In the third embodiment, when the total moving amount (Σctrlval) of the recording paper P exceeds a predetermined amount, vibration is stopped. In contrast, in the present embodiment, when the total moving amount (Σctrlval) of the recording paper P exceeds a predetermined amount, it is then determined in which of a forward direction and a reverse direction the total moving amount (Σctrlval) exceeds the predetermined amount. Then, the vibration displacement pattern is changed in accordance with the determination result.

Figure 16:
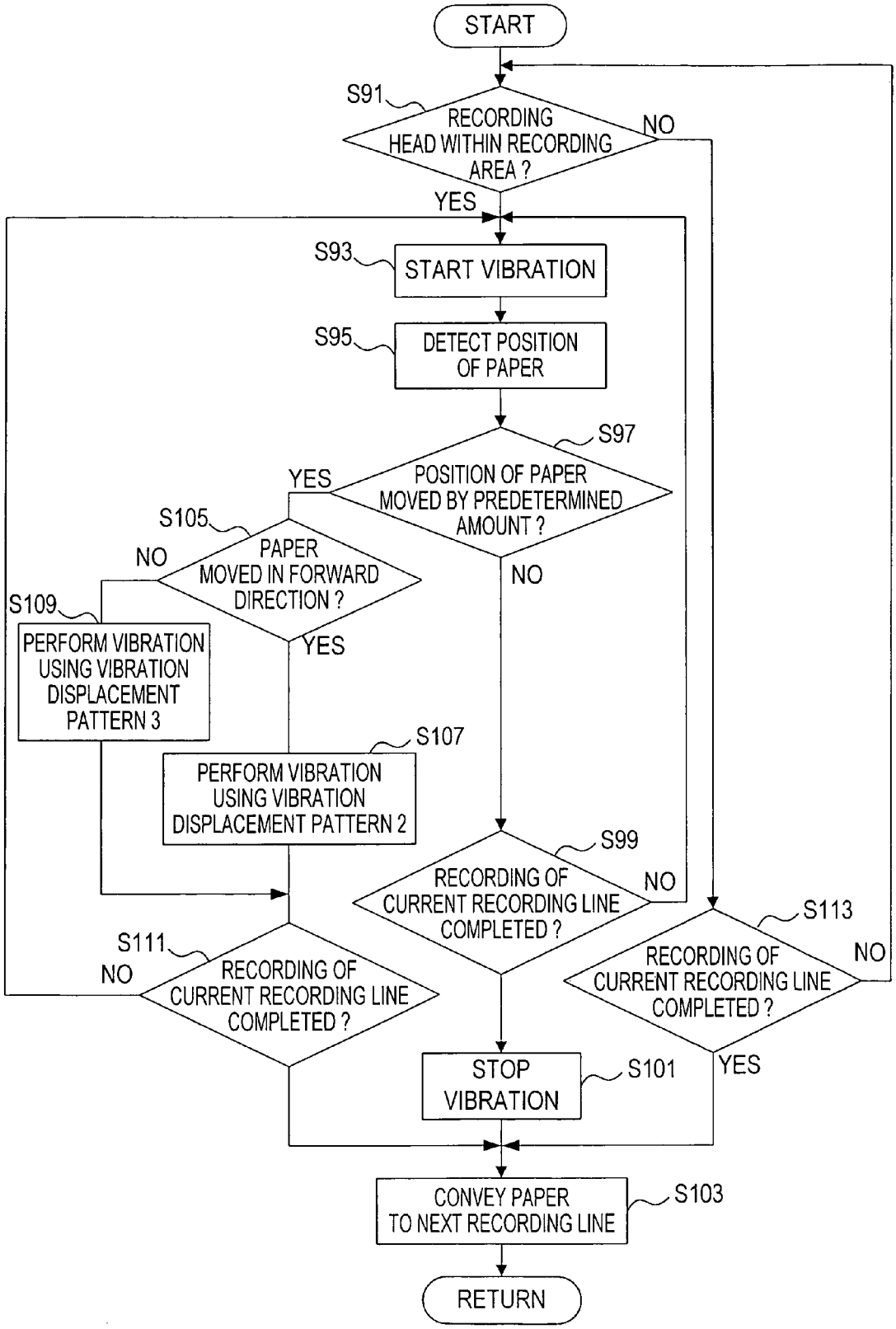
FIG. 16 is a flowchart showing a sub scanning control process flow of a printer according to a fourth embodiment of the present invention.

FIG. 16 shows a sub scanning flow schematically illustrating the sub scanning process in the present embodiment. When the sub scanning process is started, it is first determined whether or not the recording head 10 is within a recording area (S91).

When it is determined that the recording head 10 is within the recording area (S91: YES), vibration is started (S93). During the vibration, the conveying roller 41 and the paper discharge roller 45 are vibratingly rotated in forward and reverse rotating directions, and the recording paper P is minutely vibrated in the paper conveying direction (i.e., in the sub scanning direction) using Vibration Displacement Pattern 1 (see FIG. 17A).

Figure 17A:
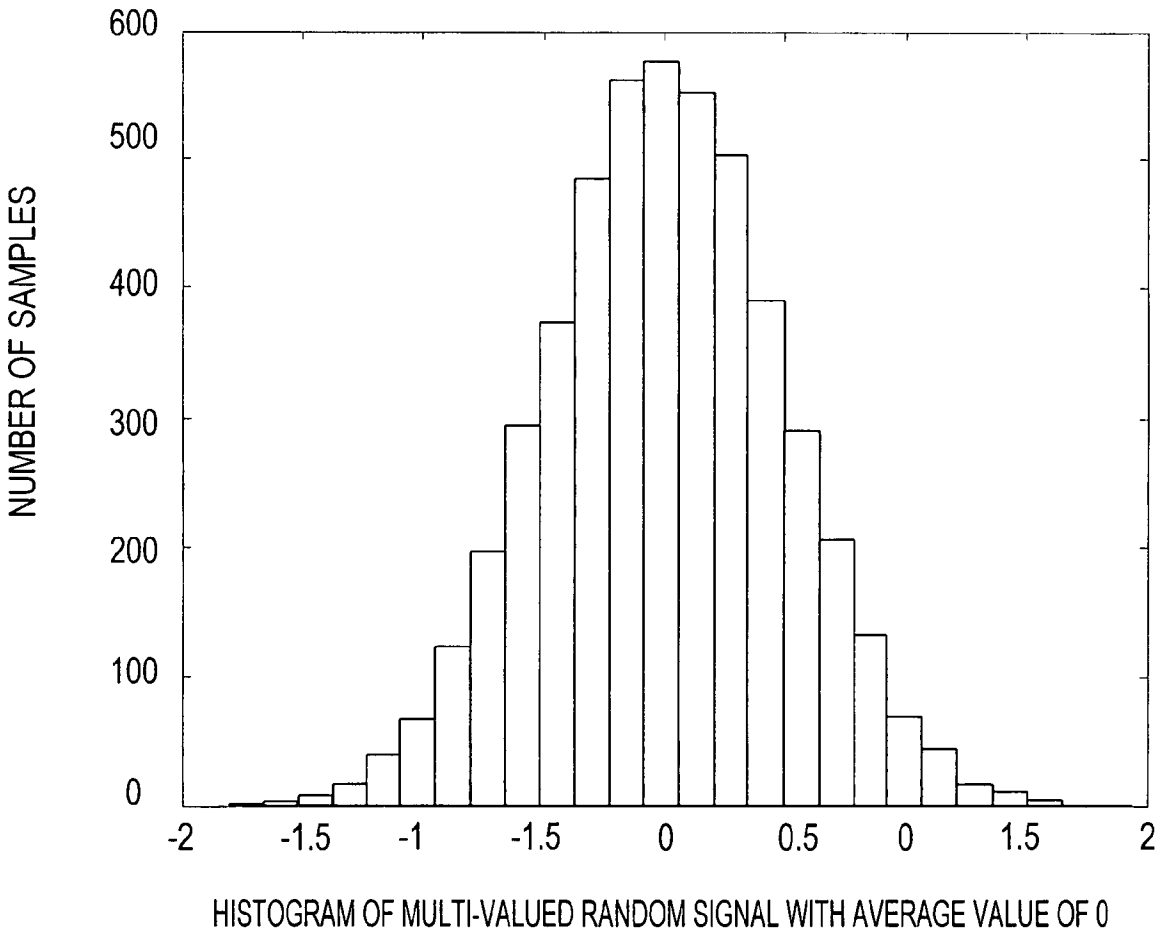
FIGS. 17A through 17C are histograms showing distributions of multi-valued random signals in the printer according to the fourth embodiment of the present invention.

In Vibration Displacement Pattern 1, random signals (oprval) are normally distributed such that an average value of the random signals (oprval) is 0 (see FIG. 17A).

When it is determined that the recording head 10 is not within the recording area (S91: NO), it is then determined whether or not the recording of the current recording line has been completed (S113).

When it is determined that the recording of the current recording line has been completed (S113: YES), the recording paper P is conveyed to a next recording line (S103). Then, the sub scanning process is terminated and the present process returns to the main control flow.

When it is determined that the recording of the current recording line has not been completed (S113: NO), the present process returns to S91.

When the vibration is started (S93), a current position of the recording paper P, i.e., a total moving amount (Σctrlval), is detected based on an output of the paper conveyance encoder 50 (S95). Then, it is determined whether or not the current position of the recording paper 50 has moved a predetermined amount from a position at which conveyance was stopped, i.e., whether or not the total moving amount (Σctrlval) exceeds the predetermined amount (S97).

If it is determined that the total moving amount (Σctrlval) is less than the predetermined amount (S97: NO), it is then determined whether or not the recording head 10 is out of the recording area, i.e., whether or not the recording of the current line has been completed (S99).

When it is determined that the recording of the current line has been completed (S99: YES), the vibration is stopped (S101), and the recording paper P is conveyed to the next recording line (S103). Then, the sub scanning process is terminated, and the present process returns to the main control flow. When it is determined that the recording of the current line has not been completed (S99: NO), the present process returns to S93.

When it is determined that the total moving amount (Σctrlval) exceeds the predetermined amount (S97: YES), it is determined in which of a forward direction and a reverse direction the total moving amount (Σctrlval) exceeds the predetermined amount (S105).

Figure 17B:
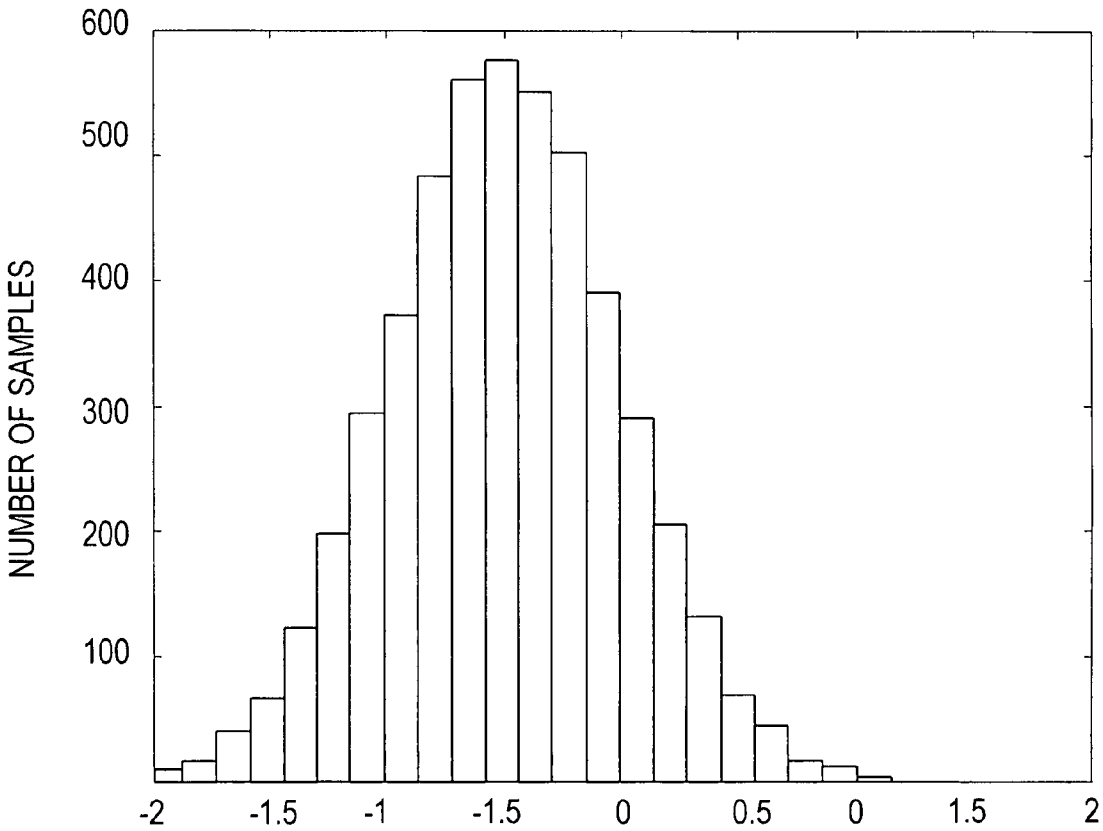

When it is determined that the total moving amount (Σctrlval) exceeds the predetermined amount in a forward direction (S105: YES), vibration of the recording paper P is performed using Vibration Displacement Pattern 2 (see FIG. 17B) (S107).

Figure 17C:
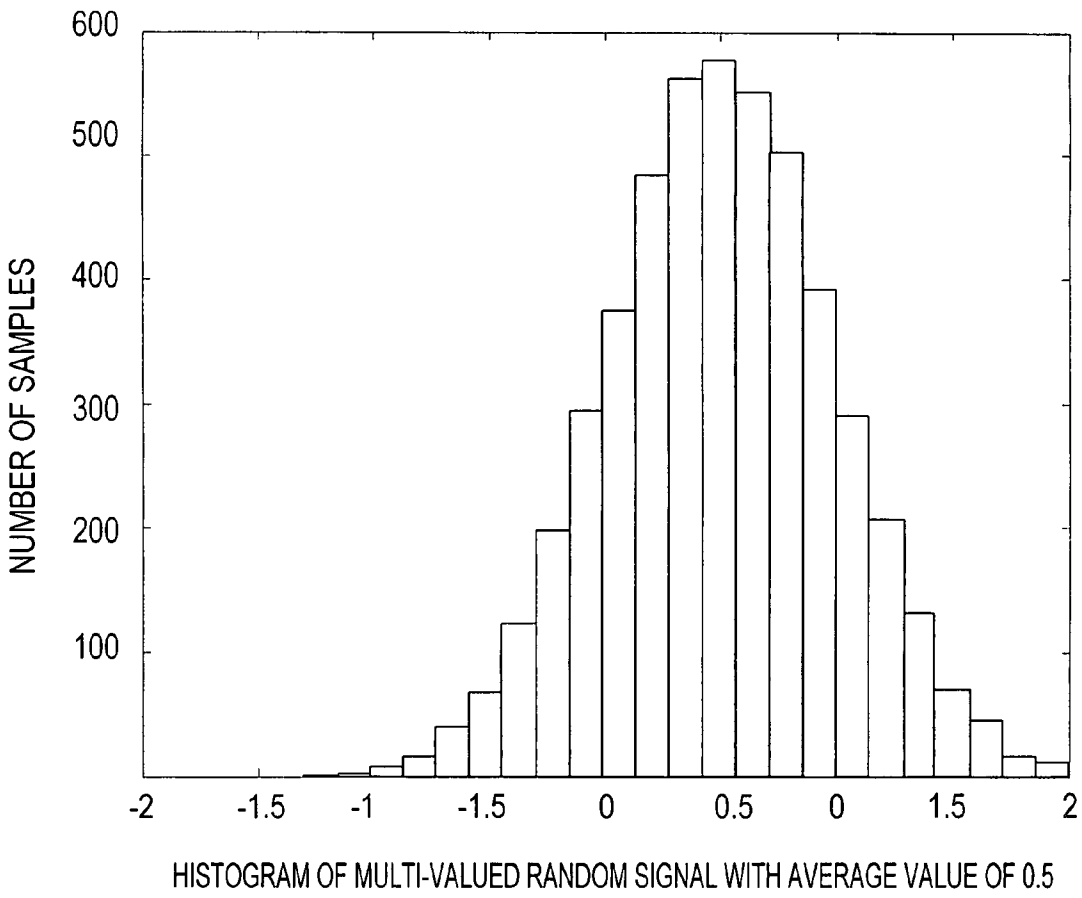

When it is determined that the total moving amount (Σctrlval) exceeds the predetermined amount in a reverse direction (S105: NO), vibration of the recording paper P is performed using Vibration Displacement Pattern 3 (see FIG. 17C) (S109).

In Vibration Displacement Pattern 2, random signals (oprval) are normally distributed such that an average value of the random signals (oprval) is on the reverse direction side (e.g., −0.5). In Vibration Displacement Pattern 3, random signals (oprval) are normally distributed such that an average value of the random signals (oprval) is on the forward direction side (e.g., +0.5).

Subsequently, it is determined whether or not the recording head 10 is out of the recording area, i.e., whether or not the recording of the current recording line has been completed (S111). When it is determined that the recording of the current recording line has been completed (S111: YES), the recording paper P is conveyed to a next recording line (S103). Then, the sub scanning process is terminated and the present process returns to the main control flow.

A feature of the present embodiment will now be described below.

When printers have substantial variations or when the state of conveyance of the recording paper P changes, the recording paper P vibrated in the same manner may be moved more than necessary and may cause appearance of more banding, as described above.

In the present embodiment, however, when the total moving amount (Σctrlval) of the recording paper P exceeds a predetermined amount, it is determined in which of the forward direction and the reverse direction the total moving amount (Σctrlval) exceeds the predetermined amount. Then, the vibration displacement pattern is changed in accordance with the determination result.

Accordingly, even when printers have substantial variations or when the state of conveyance of the recording medium changes, it is possible to minutely scatter deposit points (landing points) of ink droplets in accordance with such conditions, and thereby to prevent appearance of banding more securely.

Fifth Embodiment

In the above described embodiments, the recording paper P is vibratingly displaced with respect to the recording head 10 by forwardly or reversely rotating the paper conveying motor 40, and thus the conveying roller 41 as well as the paper discharge roller 45. In contrast, in the present embodiment, a vibration applying actuator 80 such as a piezoelement is provided so as to apply vibration to at least one of the recording paper P and the recording head 10 (the recording head 10 in the present embodiment), as shown in FIG. 18.

Figure 18:
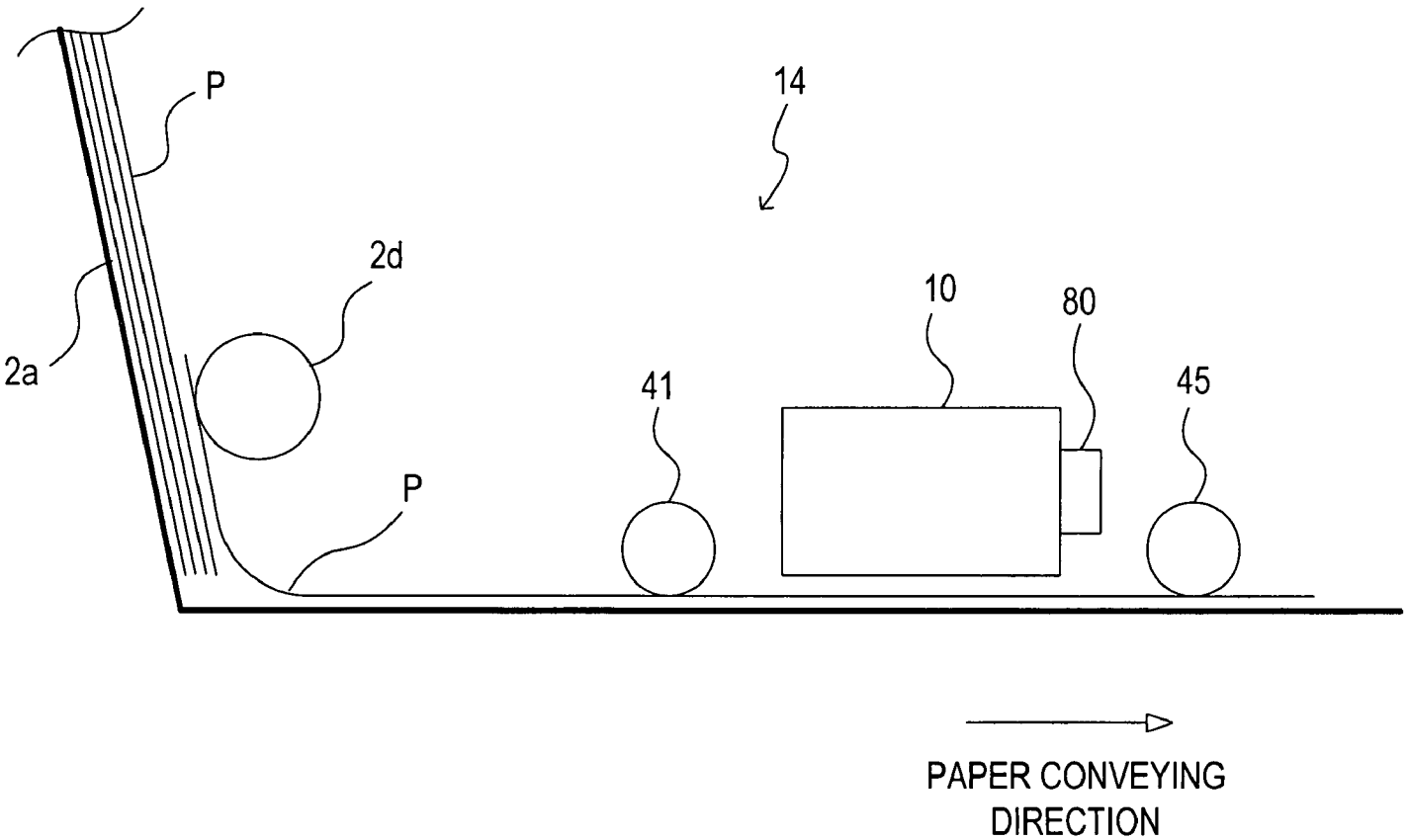
FIG. 18 is an explanatory view showing major parts of a printer according to a fifth embodiment of the present invention.

Although the vibration of the vibration applying actuator 80 is directly applied to the recording head 10 in FIG. 18, the present embodiment should not be limited to this configuration. For example, the vibration of the vibration applying actuator 80 may be indirectly applied to the recording head 10 or the recording paper P.

Sixth Embodiment

In the above described embodiments, a control signal for relatively vibrating the recording paper P with respect to the recording head 10 is generated in the form of software. In contrast, in the present embodiment, hardware that generates a control signal for relatively vibrating the recording paper P with respect to the recording head 10 is provided in the electronic control device 70 or on a special substrate, or the like, as shown by the block diagram of FIG. 19.

Figure 19:
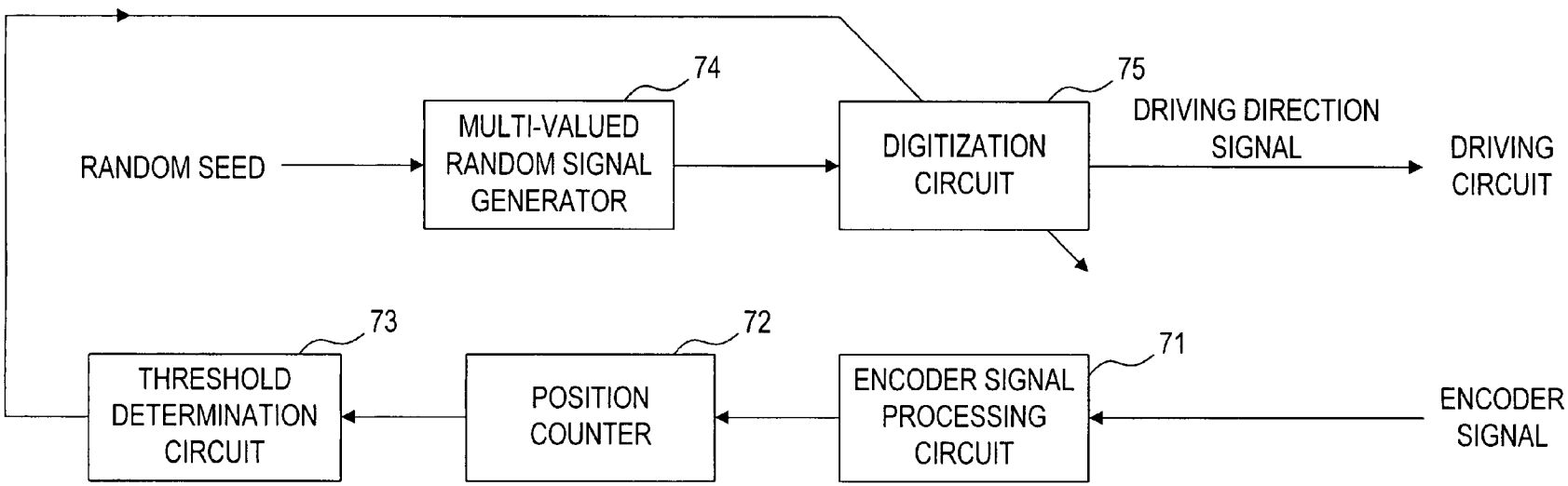
FIG. 19 is a block diagram showing electric system of a printer according to a sixth embodiment of the present invention.
Figure 20:
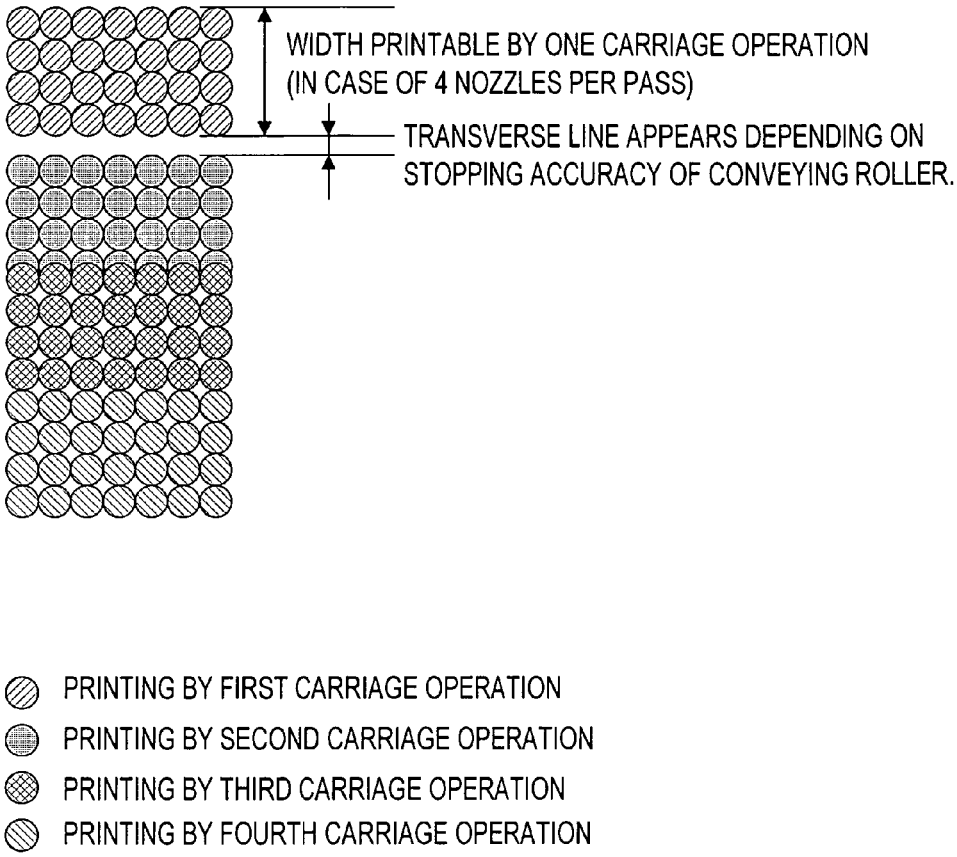
FIG. 20 is a diagrammatic view showing a cause of appearance of banding.

An encoder signal processing circuit 71 and a position counter 72 in FIG. 19 correspond to S45 in FIG. 7, and a threshold determination circuit 73 in FIG. 19 corresponds to S47 through S51 in FIG. 7. A multi-valued random signal generator 74 in FIG. 19 corresponds to S53 in FIG. 7, and a digitization circuit 75 in FIG. 9 corresponds to S55 through S59 in FIG. 7.

Although FIG. 19 is presented in connection with the printer 3 of the first embodiment, the present embodiment may be applied not only to the first embodiment, but also to the third to fifth embodiments.

Other Embodiments

Although the recording paper P is vibrated based on a multi-valued signal or an M-sequence random signal in the above described embodiments, this should not be a limitation to the present invention. For example, the recording paper P may be vibrated based on a sinusoidal wave or on another random signal.

While the recording paper P is relatively vibrated with respect to the recording head 10 by vibrating the recording paper P relatively to the recording head 10 in the first through fourth embodiments, this should not be a limitation to the present invention. For example, it may be possible to vibrate the recording head 10 relatively to the recording paper P. It may also be possible to vibrate both of the recording head 10 and the recording paper P. In this case, the recording head 10 may be vibrated by the vibration applying actuator 80, while the recording paper P may be vibrated by the conveying roller 41.

While the recording paper P is conveyed by the conveying roller 41 and the paper discharge roller 45 in the above described embodiments, this should not be a limitation to the present invention. For example, the recording paper P may be conveyed by a paper conveyor belt and a conveyor roller around which the paper conveyor belt is wound in a printer of a belt conveyor type.

While a control signal for relatively vibrating the recording paper P with respect to the recording head 10 is generated in the form of hardware in the second embodiment, this should not be a limitation to the present invention. For example, a control signal for relatively vibrating the recording paper P with respect to the recording head 10 may be generated in the form of software.

In the above described first embodiment, it is determined whether or not the printer is in the text recording mode, and also whether or not the printer is in the recording mode with a low sub scanning resolution. When the printer is in the text recording mode or in the recording mode with a low sub scanning resolution, vibration is not performed. This, however, should not be a limitation to the present invention. Vibration may always be performed during the recording regardless of the recording mode or the sub scanning resolution.

It is to be understood that the present invention should not be limited to the above described embodiments, but may be embodied in various forms without departing from the spirit and scope of the present invention as set forth in the appended claims.

What is claimed is:

1. An inkjet recording apparatus comprising:

a recording head that ejects ink toward a recording medium;

a carriage on which the recording head is mounted;

a carriage driving mechanism that moves the carriage in specified directions reciprocatingly;

a conveying device that intermittently conveys the recording medium in a direction perpendicular to the specified directions;

a vibration applying device that vibrates at least one of the recording medium and the recording head; and an image recording control device that controls the recording head, the carriage driving mechanism, the conveying device and the vibration applying device to perform recording of an image on the recording medium, wherein the image recording control device repeatedly and selectively alternates between a first state and a second state, wherein in the first state, the image recording control device controls the recording head, the carriage driving mechanism, the conveying device and the vibration applying device to, while moving the carriage in the specified directions, eject ink on the recording medium and to vibrate the at least one of the recording medium and the recording head without conveying the recording medium, and wherein in the second state, the image recording control device controls the recording head, the carriage driving mechanism, the conveying device and the vibration applying device to convey the recording medium without ejecting ink;

further comprising a vibration application prohibiting device that identifies recording data to be recorded on the recording medium by the recording head and prohibits operation of the vibration applying device when the recording data is identified as character data.

2. The inkjet recording apparatus as set forth in claim 1, further comprising a vibration pattern changing device that changes a relative vibration displacement pattern between the recording medium and the recording head while the vibration applying device is in operation.

3. The inkjet recording apparatus as set forth in claim 2, wherein the vibration pattern changing device changes the vibration displacement pattern based on a relative displacement amount between the recording medium and the recording head.

4. The inkjet recording apparatus as set forth in claim 1, wherein the vibration applying device vibratingly displaces at least one of the recording medium and the recording head based on a multi-valued random signal.

5. The inkjet recording apparatus as set forth in claim 1, wherein the vibration applying device vibratingly displaces at least one of the recording medium and the recording head based on an M-sequence random signal.

6. The inkjet recording apparatus as set forth in claim 1, further comprising a vibration application stopping device that stops operation of the vibration applying device when a relative displacement amount between the recording medium and the recording head exceeds a predetermined amount.

7. The inkjet recording apparatus as set forth in claim 1, wherein the conveying device includes:

a conveying roller that conveys the recording medium;

a drive source that drives the conveying roller; and a control device that controls the drive source, and wherein the vibration applying device is constituted by the control device controlling the drive source such that the conveying roller is vibratingly rotated in forward and reverse rotating directions.

8. The inkjet recording apparatus as set forth in claim 1, wherein the vibration applying device includes a vibration applying actuator provided so as to apply vibration to at least one of the recording medium and the recording head.

9. The inkjet recording apparatus as set forth in claim 1, further comprising a determining device configured to determine whether to cause the vibration applying device to vibrate the at least one of the recording medium and the recording head, based on a recording mode of the inkjet recording apparatus.

10. The inkjet recording apparatus as set forth in claim 9, wherein when the determining device determines to cause the vibration applying device to vibrate the at least one of the recording medium and the recording head, the recording mode is an image recording mode, wherein the data to be recorded is image data other than character data.

11. The inkjet recording apparatus as set forth in claim 9, wherein when the determining device determines to cause the vibration applying device to vibrate the at least one of the recording medium and the recording head, the recording mode is a particular recording mode having a high sub-scanning resolution.

12. A printing method for use in an inkjet recording apparatus, the inkjet recording apparatus comprising:

a recording head that ejects ink toward a recording medium;

a carriage on which the recording head is mounted;

a carriage driving mechanism that moves the carriage in specified directions reciprocatingly;

a conveying device that intermittently conveys the recording medium in a direction perpendicular to the specified directions, the printing method comprising the steps of:

applying vibration from a vibration applying device to vibrate at least one of the recording medium and the recording head;

controlling, via an image recording control device, the recording head, the carriage driving mechanism, the conveying device and the vibration applying device to perform recording of an image on the recording medium;

controlling, via the image recording control device, the recording head, the carriage driving mechanism, the conveying device and the vibration applying device, to repeatedly and selectively alternate between a first recording state and a second recording state;

ejecting ink on the recording medium and vibrating the at least one of the recording medium and the recording head without conveying the recording medium while moving the carriage in the specified directions, when in the first recording state; and conveying the recording medium without ejecting ink, when in the second recording state;

wherein recording data to be recorded on the recording medium by the recording head is identified and application of the vibration is prohibited when the recording data is identified as character data.

13. The printing method as set forth in claim 12, wherein a relative vibration displacement pattern between the recording medium and the recording head is changed while application of the vibration is performed.

14. The printing method as set forth in claim 13, wherein the vibration displacement pattern is changed based on a relative displacement amount between the recording medium and the recording head.

15. The printing method as set forth in claim 12, wherein application of the vibration is performed by vibratingly displacing the at least one of the recording medium and the recording head based on a multi-valued random signal.

16. The printing method as set forth in claim 12, wherein the application of the vibration is performed by vibratingly displacing the at least one of the recording medium and the recording head based on an M-sequence random signal.

17. The printing method as set forth in claim 12, wherein application of the vibration is stopped when a relative displacement amount between the recording medium and the recording head exceeds a predetermined amount.

18. The printing method as set forth in claim 12, wherein the conveying device of the inkjet recording apparatus includes:

a conveying roller that conveys the recording medium;

a drive source that drives the conveying roller; and a control device that controls the drive source, and wherein application of the vibration is performed by the control device controlling the drive source such that the conveying roller is vibratingly rotated in forward and reverse rotating directions.

19. The printing method as set forth in claim 12, wherein application of the vibration is performed by a vibration applying actuator provided so as to apply vibration to at least one of the recording medium and the recording head.

20. The printing method as set forth in claim 12, further comprising the step of:

determining, via a determining device, whether to vibrate the at least one of the recording medium and the recording head, based on a recording mode.

21. The printing method as set forth in claim 20, wherein when the determining step determines to vibrate the at least one of the recording medium and the recording head, the recording mode is an image recording mode, wherein the data to be recorded is image data other than character data.

22. The printing method as set forth in claim 20, wherein when the determining step determines to vibrate the at least one of the recording medium and the recording head, the recording mode is a particular recording mode having a high sub-scanning resolution.

* * * * *